US008721413B2

(12) United States Patent
Mohammed et al.

(10) Patent No.: US 8,721,413 B2
(45) Date of Patent: May 13, 2014

(54) COMPUTER GAME WITH A TARGET NUMBER OF FORMATIONS CREATED FROM FALLING PIECES IN A TRIANGULAR GRID

(75) Inventors: Jameel Akhtab Mohammed, Sydney (AU); Faiaz Seddiq, Sydney (AU)

(73) Assignees: Jameel Akhtab Mohammed, New South Wales (AU); Skyecandy Pty Ltd, New South Wales (AU)

( * ) Notice: Subject to any disclaimer, the term of this patent is extended or adjusted under 35 U.S.C. 154(b) by 13 days.

(21) Appl. No.: 13/253,962

(22) Filed: Oct. 5, 2011

(65) Prior Publication Data

US 2012/0088562 A1 Apr. 12, 2012

Related U.S. Application Data

(60) Provisional application No. 61/390,305, filed on Oct. 6, 2010.

(51) Int. Cl.
*A63F 13/00* (2006.01)

(52) U.S. Cl.
USPC ..... 463/9; 463/7; 463/10; 463/13; 463/29

(58) Field of Classification Search
CPC ..... A63F 13/10; A63F 9/24
USPC ..... 463/7, 9, 10, 13, 29
See application file for complete search history.

(56) References Cited

U.S. PATENT DOCUMENTS

| | | | | | |
|---|---|---|---|---|---|
| 5,532,122 | A * | 7/1996 | Drukier | ..... | 435/5 |
| 6,093,104 | A * | 7/2000 | Kasahara et al. | ..... | 463/30 |
| 7,785,200 | B2 * | 8/2010 | Nakajima | ..... | 463/33 |
| 7,878,891 | B2 * | 2/2011 | Chiu | ..... | 463/9 |
| 8,267,761 | B2 * | 9/2012 | Hagiwara | ..... | 463/9 |
| 2007/0224632 | A1 * | 9/2007 | Mitsuhashi | ..... | 435/6 |
| 2010/0016065 | A1 * | 1/2010 | Nicely et al. | ..... | 463/25 |
| 2010/0234083 | A1 * | 9/2010 | Hagiwara | ..... | 463/9 |

* cited by examiner

*Primary Examiner* — James S McClellan
*Assistant Examiner* — Shahid Kamal
(74) *Attorney, Agent, or Firm* — White-Welker & Welker, LLC; Matthew T. Welker, Esq.

(57) ABSTRACT

A puzzle game where the objective of the game is to create a target number of HEXA and DIA formations per level using a set of primary sub-formations. The game is further intensified by the introduction of secondary sub-formations and a set of Reward Buttons that are awarded for completing different formations. The present invention uses a novel way of scoring where points are calculated based on the formations created by a player and the time remaining in the level. Therefore, if a player finishes a level faster, the player gets additional points. There is also an Infinite game mode for PDA and mobile phone users that allows play until the battery in the device runs out or the device shuts off due to a low battery that has no set levels and set scoring based on various possible formations only.

19 Claims, 21 Drawing Sheets

Before color interchange After color interchange

| | JUPITER | INFINITY |
|---|---|---|
|  HEXA | Time/4 | 200 |
|  DIA | Time | 800 |
|  DI-HEXA | 2x HEXA | 400 |
|  HEX-TRIA | 3x HEXA + DIA | 1400 |

COMPUTER GAME WITH A TARGET NUMBER OF FORMATIONS CREATED FROM FALLING PIECES IN A TRIANGULAR GRID

CROSS REFERENCE TO RELATED APPLICATIONS

This application claims priority from U.S. Patent Application Ser. No. 61/390,305, entitled "COMPUTER GAME WITH A TARGET NUMBER OF FORMATIONS CREATED FROM FALLING PIECES IN A TRIANGULAR GRID", filed on 6 Oct. 2010. The benefit under 35 USC §119(e) of the United States provisional application is hereby claimed, and the aforementioned application is hereby incorporated herein by reference.

FEDERALLY SPONSORED RESEARCH

Not Applicable

SEQUENCE LISTING OR PROGRAM

Not Applicable

TECHNICAL FIELD OF THE INVENTION

The present invention relates to digital electronics, and more specifically, to a computer game.

BACKGROUND OF THE INVENTION

Computer games are a widely popular form of entertainment. A genre of abstract game that has been found to be enjoyable by many is the block-based game. A popular game in this category is "TETRIS", originally created by Alexey Pazhitnov but having been implemented in many subsequent variations. In "TETRIS", a player must maneuver (translate and rotate) varied and odd-shaped falling blocks such that the blocks form complete rows in the playing grid. When the player makes a complete row, the blocks of that row are deleted and points are awarded.

Another example of an abstract block-based game, is U.S. Patent Application Publication No. 2005/0043075 entitled "COMPUTER GAME WITH MATCHABLE BLOCKS". A playing grid includes cells for holding objects of different types, and a cursor that when moved exchanges positions in the grid with an adjacent object. The cursor is prevented from leaving the bounds of the grid. Horizontally or vertically lined-up matchable objects of the same type are deleted. Objects are moved in the grid to cells adjacent to and below unless occupied by other objects. A new row of objects is created below the bottommost row of the playing grid, and shifted up into the grid displacing other objects in the grid up. In an expert mode, falling objects are created at the top of the grid, and objects can be transformed into other objects. In a multiplayer mode, objects can be exchanged and deleted from two playing grids depending on player performance.

The relatively simple characteristic of block-based games coupled with their wide appeal makes games of this genre well suited for mass produced portable consumer devices such as a mobile phones and PDAs. Given the small and somewhat cramped input means of such portable devices and the wide variety of people who use them, it is a significant challenge to develop an exciting and stimulating block-based game.

SUMMARY OF THE INVENTION

A puzzle game developed first for the IPHONE and IPOD TOUCH. The objective of the game is to create a target number of hexagonal (referred to as "HEXA") and diagonal (referred to as "DIA") formations per level using a set of Primaries (also known as primary sub-formations) in a Triangular Grid. The game is further intensified by the introduction of Secondaries (also known as secondary sub-formations) and a set of Rewards, also referred to as Reward Buttons, which are awarded for completing different formations. The present invention uses a novel way of scoring where points are calculated based on the formations created by a player and the time remaining in the level. Therefore, if a player finishes a level faster, the player gets additional points. There is also an Infinite game mode for PDA and mobile phone users that allows them to play until the battery in their device runs out or the device shuts off due to a low battery. This Infinity game mode has no set levels and set scoring based on various possible formations only.

Therefore, an object of the present invention is to provide a method for a puzzle game that includes falling pieces and their movements and formations bound by a Triangular Grid, which can be executed by a computer, PDA or mobile device.

In a specific embodiment, the present invention provides a method and system for a puzzle game where a set of Primaries (also known as sub-primary formations) made up of one or a plurality of triangle pieces joined together, fall from the top of a Triangular Grid, moving downwards to the next available cell available, one at a time, and they can be rotated by a predetermined angle following one of many methods, moved horizontally left and right into adjacent cells following any one of many methods, can be influenced in its state by using a Reward Button, moved down gently or quickly in order to land them into positions to achieve the creation of a target number of formations.

The game is further intensified by the introduction of a set of Secondaries (also known as secondary sub-formations) made up of one or a plurality of triangle pieces joined together, that each have a different attribute to each other or to Primary pieces, and by the introduction of a set of Reward Buttons, which are awarded for completing different formations. Reward Buttons allow the player to influence the state of a current falling piece or to influence the state of the next falling piece that is queued.

The Triangular Grid includes a framework of triangular cells each capable of holding one triangle piece of a Primary or Secondary piece at a time. The Triangular Grid can be bound within a rectangular area, or any regular or any irregular shaped area can bind it. The Triangular Grid can be completely filled with triangular cells, or it can be a combination of areas with triangular cells and areas where the regular triangular cells are missing. Areas with missing triangular cells provide added degree of difficulty in the game.

In one embodiment of the present invention, the set of Primaries is made of triangle pieces, each made of one or a plurality of colors. In this embodiment, formations include but are not limited to single colored or multi-colored two or higher dimensional geometric shapes, forms and objects such as diagonals, honeycombs, polygons, polyhedra, polytopes, and polydrafters.

In another embodiment of the present invention, the set of Primaries is made of triangle pieces, each made of one or a plurality of colors, and each individual triangle piece also includes one or more Grapheme. For this embodiment, formations include but are not limited to the construction of Words, Names, Phrases, Clauses and Sentences using Grapheme in the arrangement of Geometric shapes, forms and objects.

In still another embodiment, formations include tessellations and tiling. Tiling formations allow for jigsaw puzzles where the entire set of Primaries, or a small set from it include part of a subject, theme, object or picture, and these can be influenced and interlocked to assemble the final picture.

The present invention uses a novel way of scoring where points are calculated based on the formations created by a player and the time remaining in the level. Therefore, the faster a player finishes a level, the higher the points they earn.

The present invention also includes an Infinite game mode executable on a PDA or mobile device that allows players to play until the battery in their device runs out or the device shuts off due to a low battery. Infinite game mode has no defined levels and set scores are awarded to various possible formations that can be made. To provide added degree of difficulty in this mode, the Triangular Grid can begin to lose some of its triangular cells for empty cells, providing a smaller grid area to create formations.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

In the following are detailed descriptions of the invention of exemplary embodiments. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention.

The basic concept of this game will be discussed first. In this game, a set of Primary pieces made up of one or a plurality of triangle pieces joined together, fall from the top of a Triangular Grid in random order, one after another, moving downwards within the bounds of the grid. Primary pieces are capable of rotation, which may follow one of many methods, within the bounds of the Triangular Grid. Primary pieces are also capable of horizontal movement both left and right into adjacent cells following one of many methods, within the bounds of the Triangular Grid. They can also be influenced in their state by certain Secondary pieces or Reward Buttons. The challenge for the player is to create different target formations, possible in different embodiments of the invention, by moving, rotating or influencing Primary pieces as they travel downward.

Figure 1A:
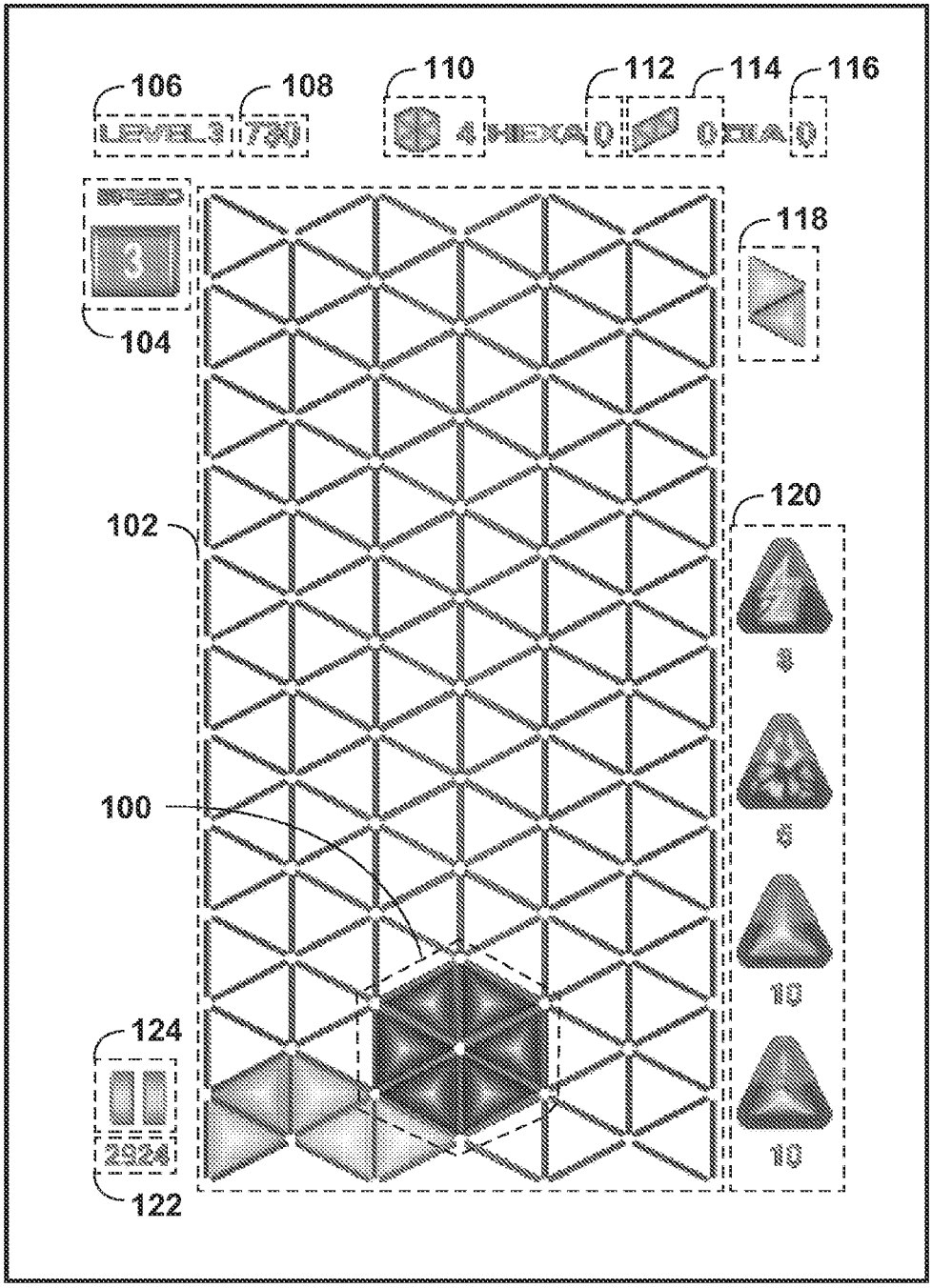
FIG. 1*a* is a representative view showing one example of a game screen and a example formation of a single colored HEXA (Hexagon) formation as displayed on a PDA or mobile device according to an embodiment of the present invention.
Figure 1B:
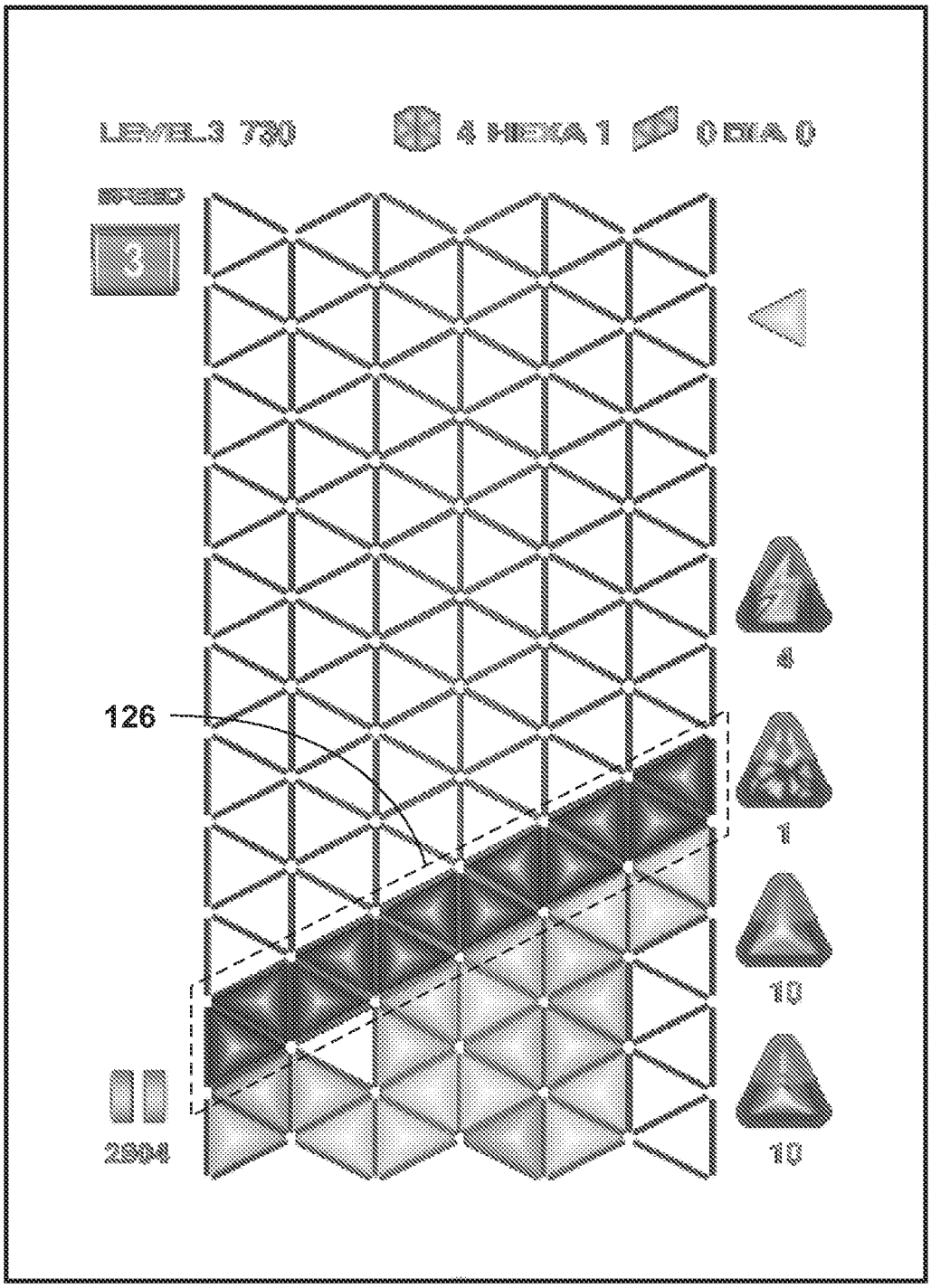
FIG. 1*b* is a representative view showing one example of a game screen and a example formation of a single colored DIA (Diagonal) formation as displayed on a PDA or mobile device according to an embodiment of the present invention.
Figure 2A:
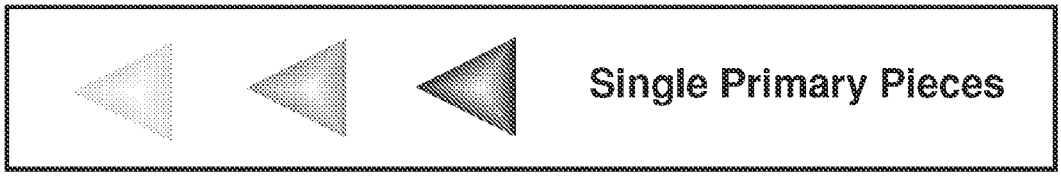
FIGS. 2*a*-2*d* illustrate the Primary falling game pieces according to an embodiment of the present invention.
Figure 2B:
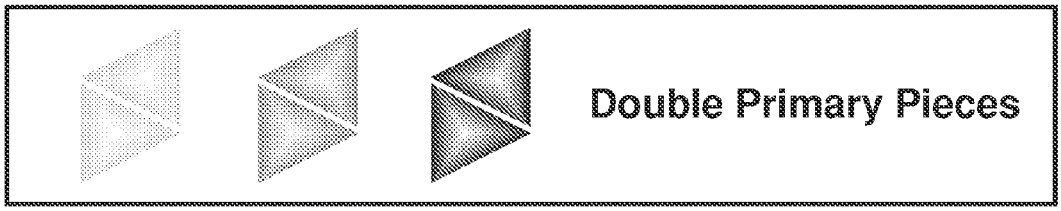
Figure 2C:
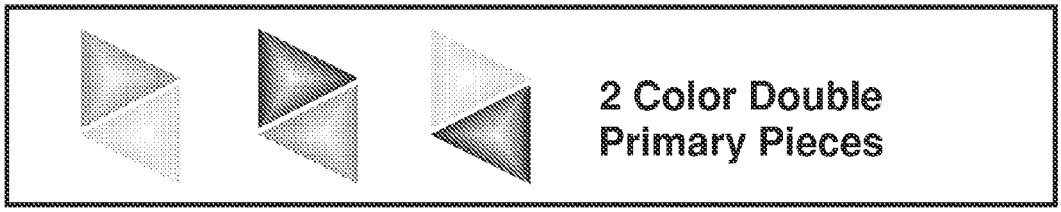
Figure 2D:
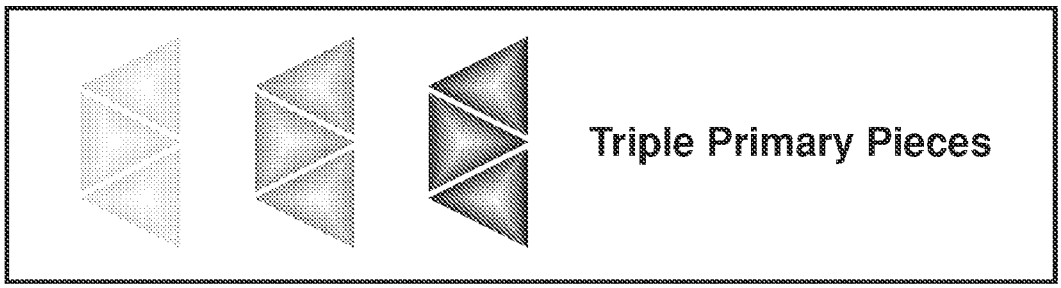

Referring to FIGS. 1*a* and 1*b*, the two-dimensional graphics of a game are shown. FIGS. 1*a* and 1*b* are representative screen shots of the game as displayed on a PDA or mobile device. FIG. 1*a* shows an example single-colored HEXA (hexagon) formation 100 while FIG. 1*b* shows an example single-colored DIA (diagonal) formation 126 on the top most rows where pieces have landed. The game is a general view of the computer game method according to one embodiment of the present invention. The game can easily be rendered on the display of a portable device, such as a mobile phone, PDA, or on the screen of a typical computer.

According to this embodiment, the objective of the game is to create a target number of formations of geometric shapes, forms and objects (which includes hexagons and diagonals) per level using a set of Primary pieces. Primary pieces are collectively referred to as Primaries (also known as primary sub-formations), which fall in random order from the top to the Triangular Grid moving towards the bottom of the grids. Primaries are made up of either one or a plurality of triangle pieces joined together.

The game is intensified by introducing a set of Secondary pieces. Secondary pieces are collectively referred to as Secondaries (also known as secondary sub-formations), which, like Primaries, fall in random order from the top to the Triangular Grid moving towards the bottom of the grid, but less frequently than Primary pieces. Secondaries are made up of either one or a plurality of triangle pieces joined together. Each Secondary piece has a different attribute to each other or to Primary pieces.

The game is further intensified by introducing a set of Rewards that are provided to the player using Reward Buttons. A Reward is awarded to a player when they complete a formation. Different formations completed can provide different capacity and types of Rewards. Reward Buttons allow the player to influence the state of a current falling game piece or to influence the state of the next falling game piece that is queued.

The present invention uses a novel way of scoring where points are calculated based on the formations created by a player and the time remaining in the level. Therefore, the faster a player finishes a level, the higher the points earned are.

The game includes a Triangular Grid of triangular cells defined by grid lines, which are rendered and aid understanding of the invention and ease playability. The grid is set into a frame that bounds the playing area of the game. The Triangular Grid can be bound within a rectangular area, or any regular or any irregular shaped area can bind it. The Triangular Grid can be completely filled with triangular cells, or it can be a combination of areas with triangular cells and areas where the regular triangular cells are missing. Areas with missing triangular cells provide added degree of difficulty in the game.

In the example screenshots of FIGS. 1*a* and 1*b*, the Triangular Grid 102 is made up of six columns and twenty-one rows of cells. Collectively the cells can hold a hundred and twenty six individual triangle pieces. The triangular cells are capable of holding one triangle piece of a Primary or a Secondary piece at a time. Triangle pieces held by cells can be of any color; however, the triangle pieces must be in the same orientation in order to fit into a cell. The triangle pieces are movable by a player as part of a whole unit of the Primary or Secondary piece they construct, through input means (example a Touchscreen gesture, keypad, joystick, Touch pad, or other) of the portable device or computer. The triangle pieces can be moved left, right, and down, as part of a whole unit of the Primary or Secondary piece they construct, within the bounds of the grid. Furthermore, the triangle pieces can be influenced to rotate them or be held to place it into a horizontal position, as part of a whole unit of the Primary or Secondary piece they construct.

FIG. 1*a* also shows a Level indicator 106, the Score 108, the Target HEXA formations 110 for the level, the number of HEXA formations 112 the player has created so far in the level, the Target DIA formation 114 for the level, the number of DIA formations 116 created so far in the level, an upcoming Primary piece Preview 118, the Speed Setting 104, a Pause Button 124, and a Count Down Clock 122 that shows the time remaining to reach the level target and Reward Buttons 120.

Now referring to FIGS. 2*a*-2*d* illustrate the set of Primaries taught by one embodiment of the present invention. Primaries, the primary falling pieces in the game, include single triangle pieces of varying color, double triangle pieces where two triangles are oriented such that one side of each triangle is opposite and parallel to each other, and triple triangles that are arranged to form a trapezoidal shape wherein two triangles surround a middle triangle oriented opposite of the two end triangles. Singles triangles can be in any color. Double triangles can either be comprised of two similar colored triangles or two triangles of any two colors. Triple triangles can be comprised of three similar colored triangles or three triangles with any color from three different colors.

Primary Game pieces may be maneuvered by a player into a desired position before they reach either the bottom of the grid or another game piece that does not allow the falling game piece to continue its downward falling motion and it becomes fixed on the grid. A player may maneuver the piece to the left, right, or increase its rate of fall in the downward direction. A player cannot maneuver the piece up above any row past where the piece has fallen.

In one embodiment of the present invention, the set of Primaries is made of triangle pieces, each made of one or a plurality of colors. In this embodiment, formations include but are not limited to single colored or multi-colored two or higher dimensional geometric shapes, forms and objects such as diagonals, honeycombs, polygons, polyhedra, polytopes, and polydrafters.

A Triangular Grid offers more than one specific method to handle game piece rotations. Only some of these methods, stating specific degrees of rotation per piece, are described here.

A single triangle piece, whether they are a Primary or Secondary piece, can be tapped or influenced to rotate it 180 degrees. A double triangle, whether Primary or Secondary, and of two similar colored triangles or two different colored ones, can be tapped or influenced to rotate it 180 degrees or held down to rotate it to a horizontal orientation in the grid. A triple triangle, whether Primary or Secondary, can be tapped to rotate it 180 degrees.

In the game, if the player has not created the target number of formations in a level yet, but falling Primaries have stacked up from the bottom and reach the top of the Triangular Grid, the game ends. If the player has reached the target number of formations in a level before the falling Primaries has reached the top of the Triangular Grid, the level completes and the player moves onto the next level. In the event that the player was in the final level of the game when this happened, the game completes.

Figure 3A:
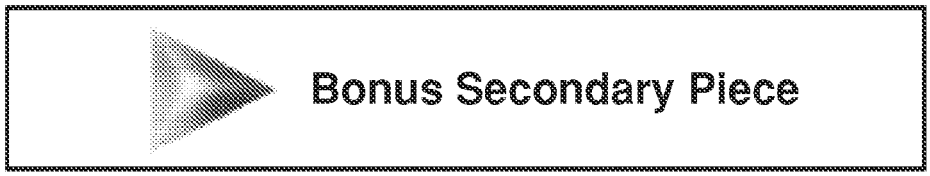
FIGS. 3*a*-3*e* illustrate the Secondary falling game pieces and two reward buttons according to the embodiment of the present invention.
Figure 3B:
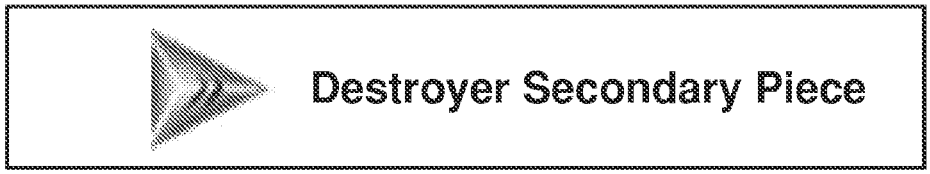
Figure 3C:
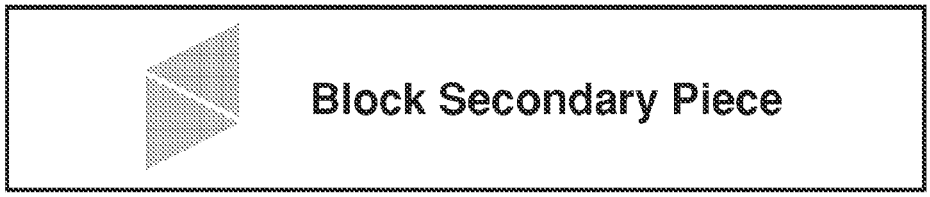

FIGS. 3*a*-3*c* show the set of Secondaries taught by one embodiment of the present invention. In this example, Secondaries include but are not limited to: Bonus, Destroyer, and Block. The Bonus Secondary Piece substitutes any single Primary triangle so that it can represent any color. The player can move and rotate the Bonus Secondary Piece like any other single triangle Primary piece. The Destroyer Secondary Piece destroys everything as it falls in its path. The player can move and rotate the Destroyer Secondary Piece like any other single triangle primary piece. The Block Secondary Piece blocks the grid cells where it lands, disallowing the creation of any formation on those cells. The player can move and rotate the Block Secondary Piece like any other Double Primary piece.

Figure 3D:
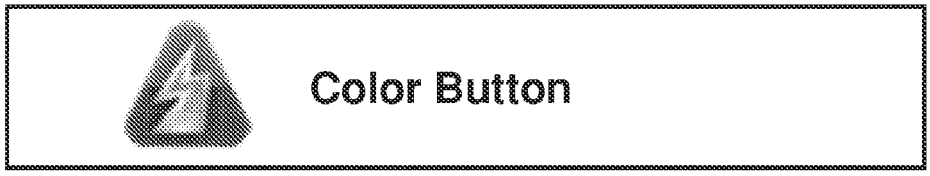

Additional Game Reward buttons may be presented to the player, awarded on the creation of formations, in specific or all Game levels. FIG. 3*d* shows a Color Button that allows a player to change the color of a falling Primary piece by tapping or influencing the Color Button any number of times, in turn taking the falling Primary piece through all the possible colors, before the piece lands.

Figure 3E:
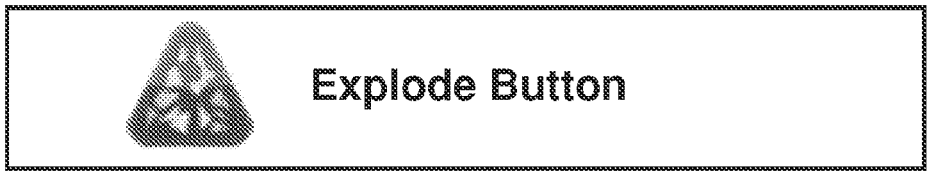

FIG. 3*e* shows an Explode Button allows a player to explode a falling piece before it lands by tapping or influencing the Explode Button. A Bonus button allows a player to change the next, previewed and queued, falling Primary piece to a Bonus Secondary Piece by tapping or influencing the Bonus button. A Destroyer button allows a player to change the next, previewed and queued, falling Primary piece to a Destroyer Secondary Piece by tapping or influencing the Destroyer button.

Independent of player input moving the falling pieces, a process is generally ongoing and is performed periodically upon the final position of each falling game piece in the grid. Upon a game piece reaching a fixed point in the grid, created formations or objects matching the desired game formations are deleted and upon such deletion any remaining objects in the grid that were above the deleted pieces then fall downward in the grid without the player having the ability or opportunity to manipulate them until the pieces reach a new fixed position in the grid. Upon this movement, the process is repeated again to check if any formations matching the desired game formations have been created. Upon the successful creation, detection, and deletion of a desired game formation, the player is awarded points.

Figure 4A:
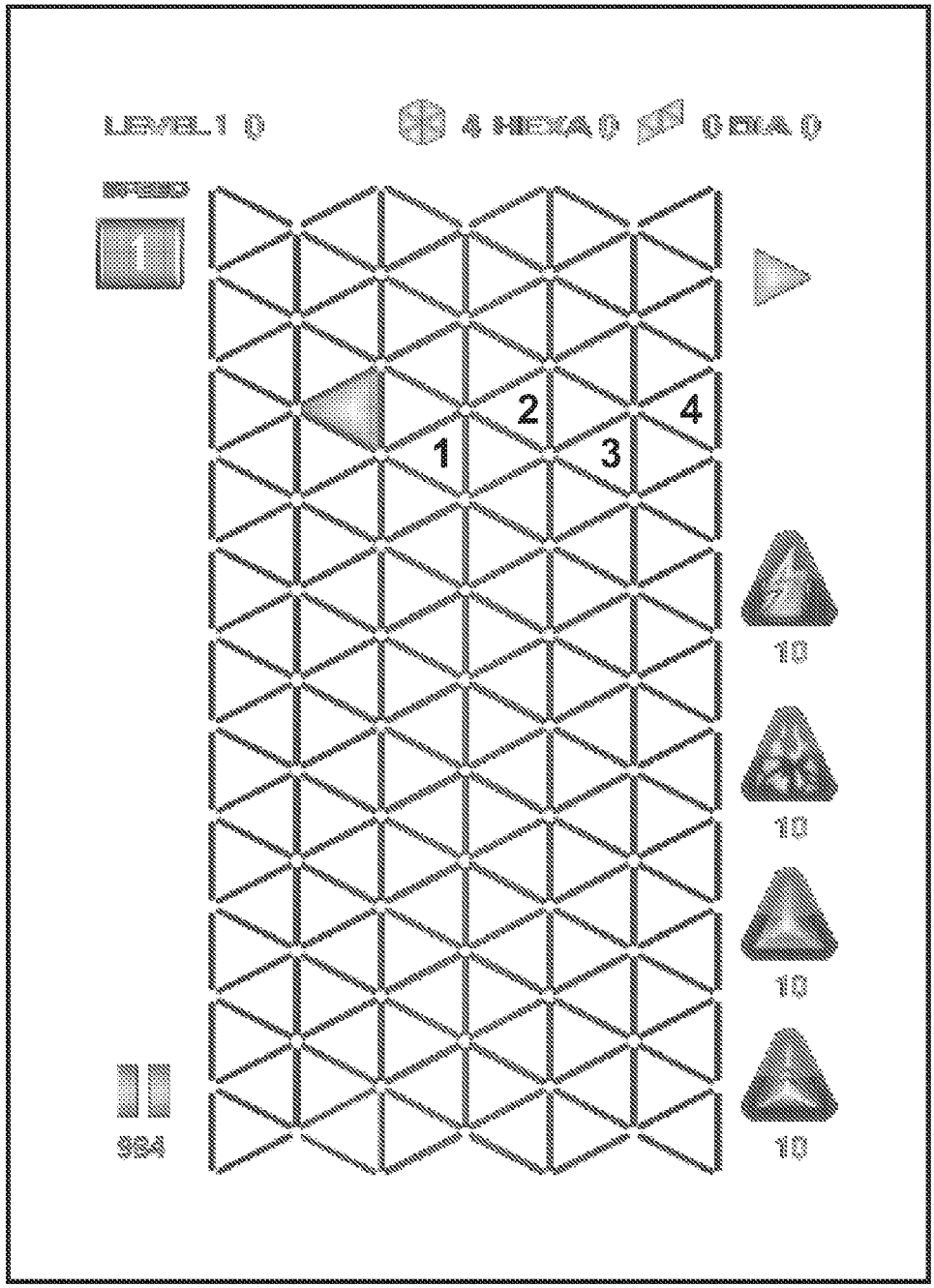
FIGS. 4*a*-4*o* illustrate some methods of horizontal movement, rotations and custom movement falling game pieces can perform according to the embodiment of the present invention.
Figure 4B:
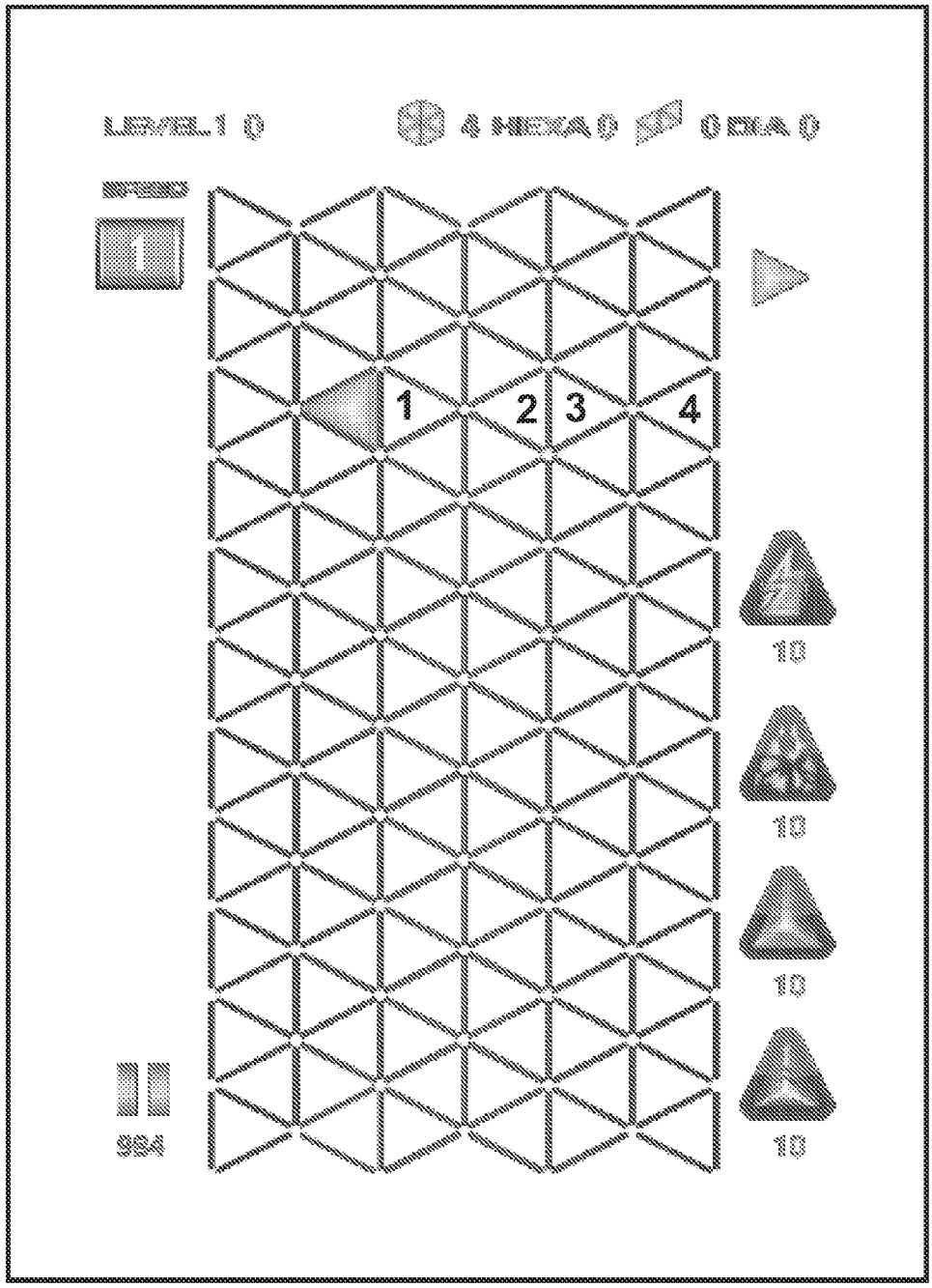
Figure 4C:
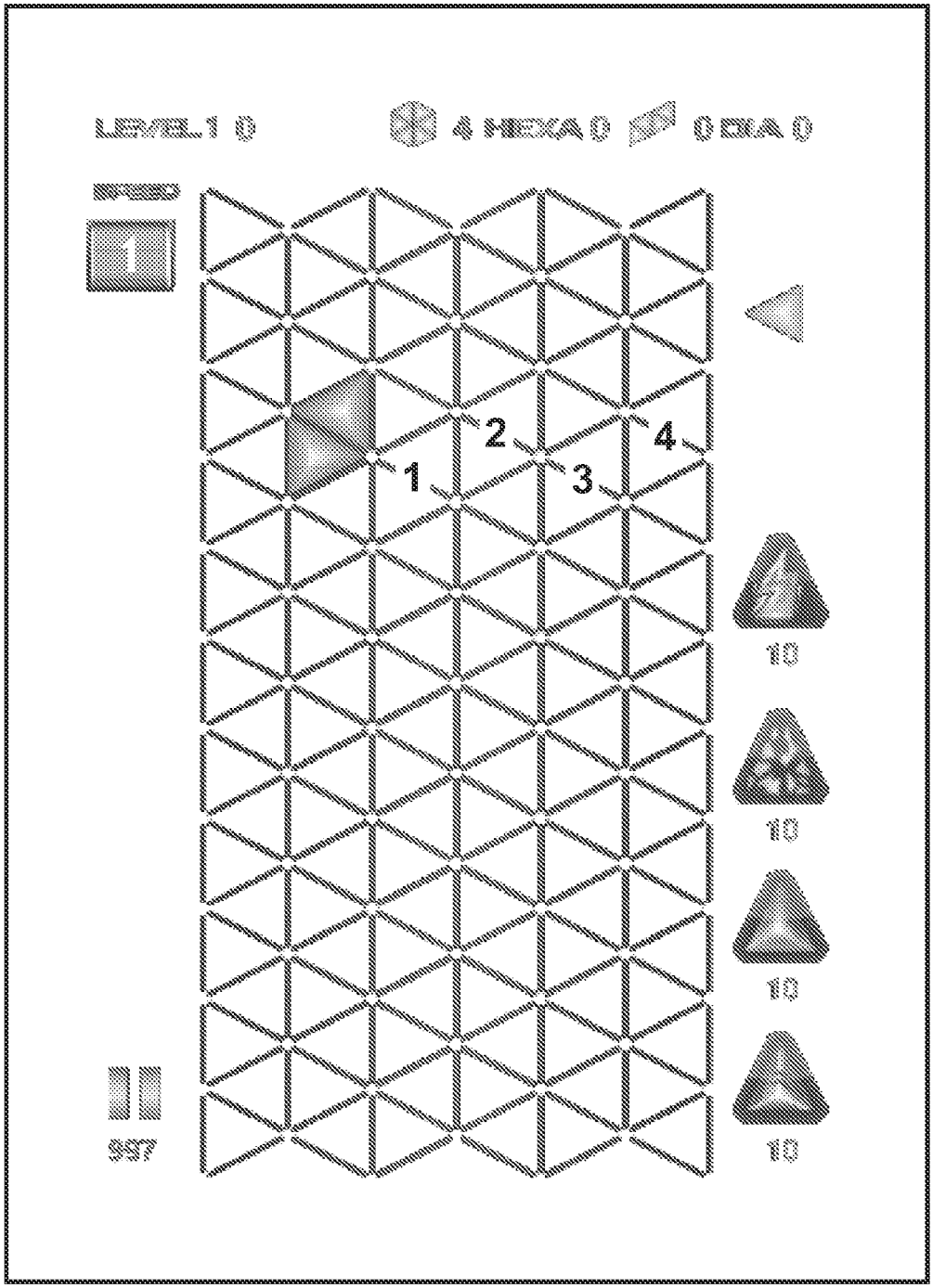
Figure 4D:
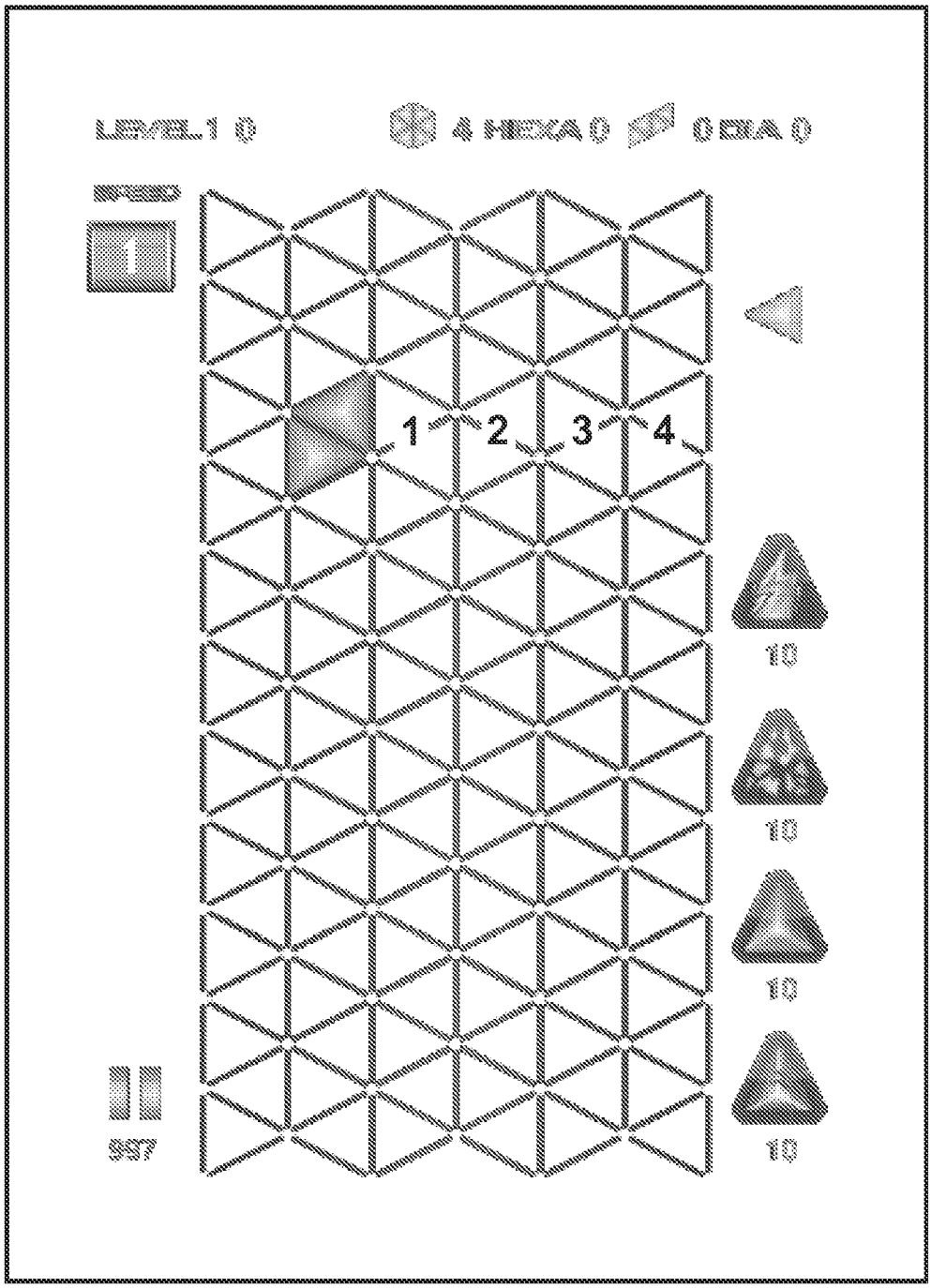
Figure 4E:
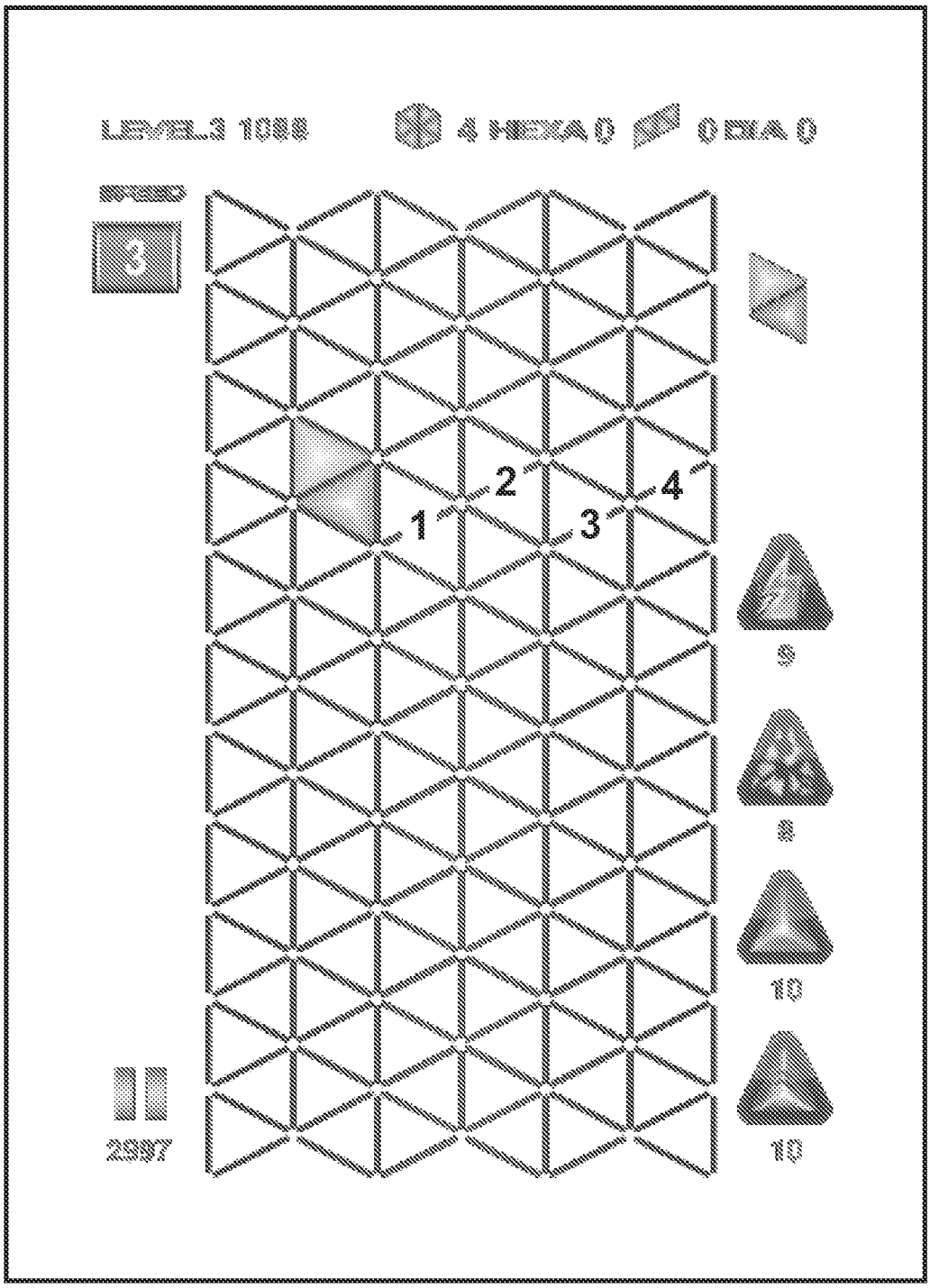
Figure 4F:
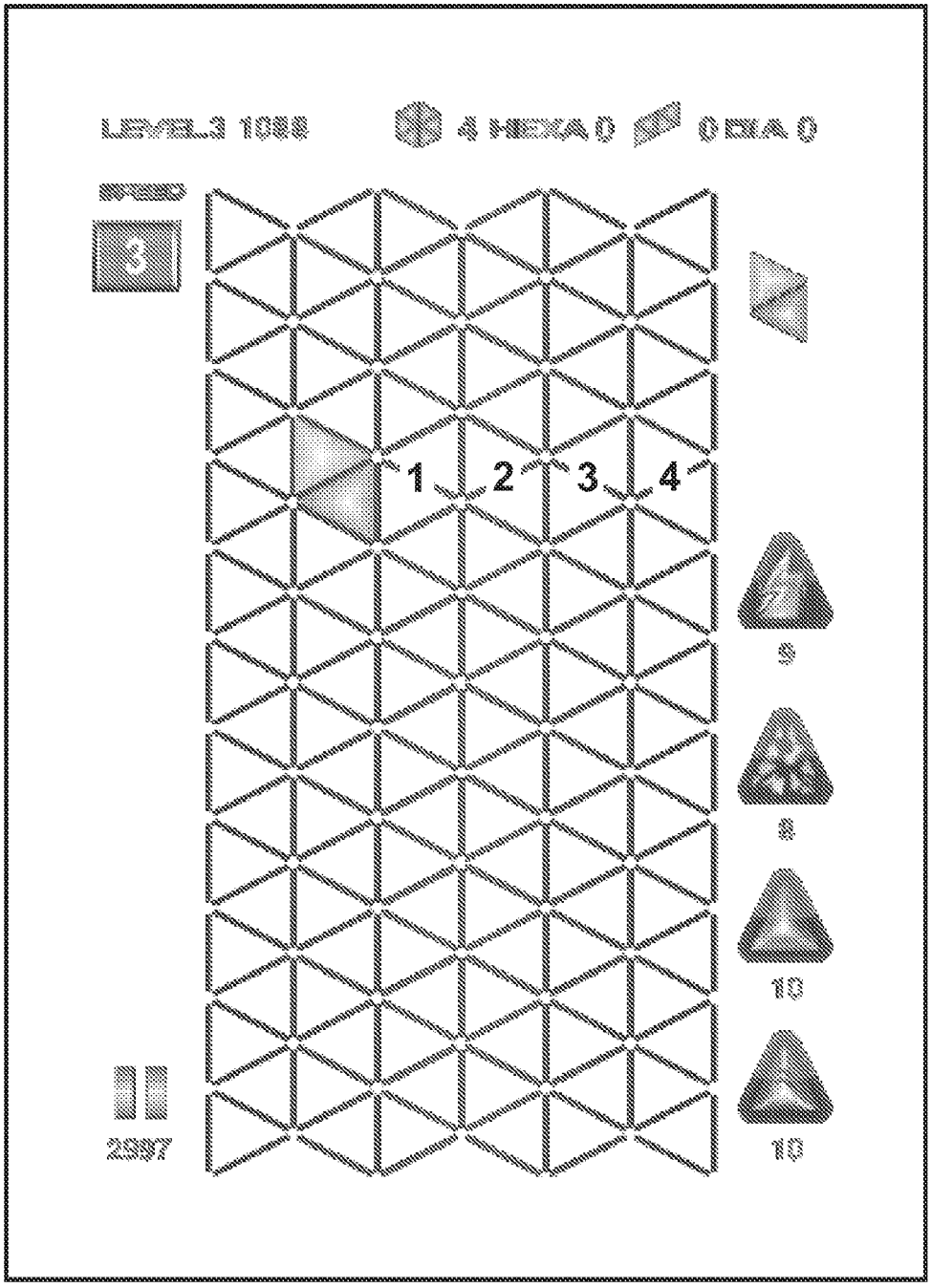
Figure 4G:
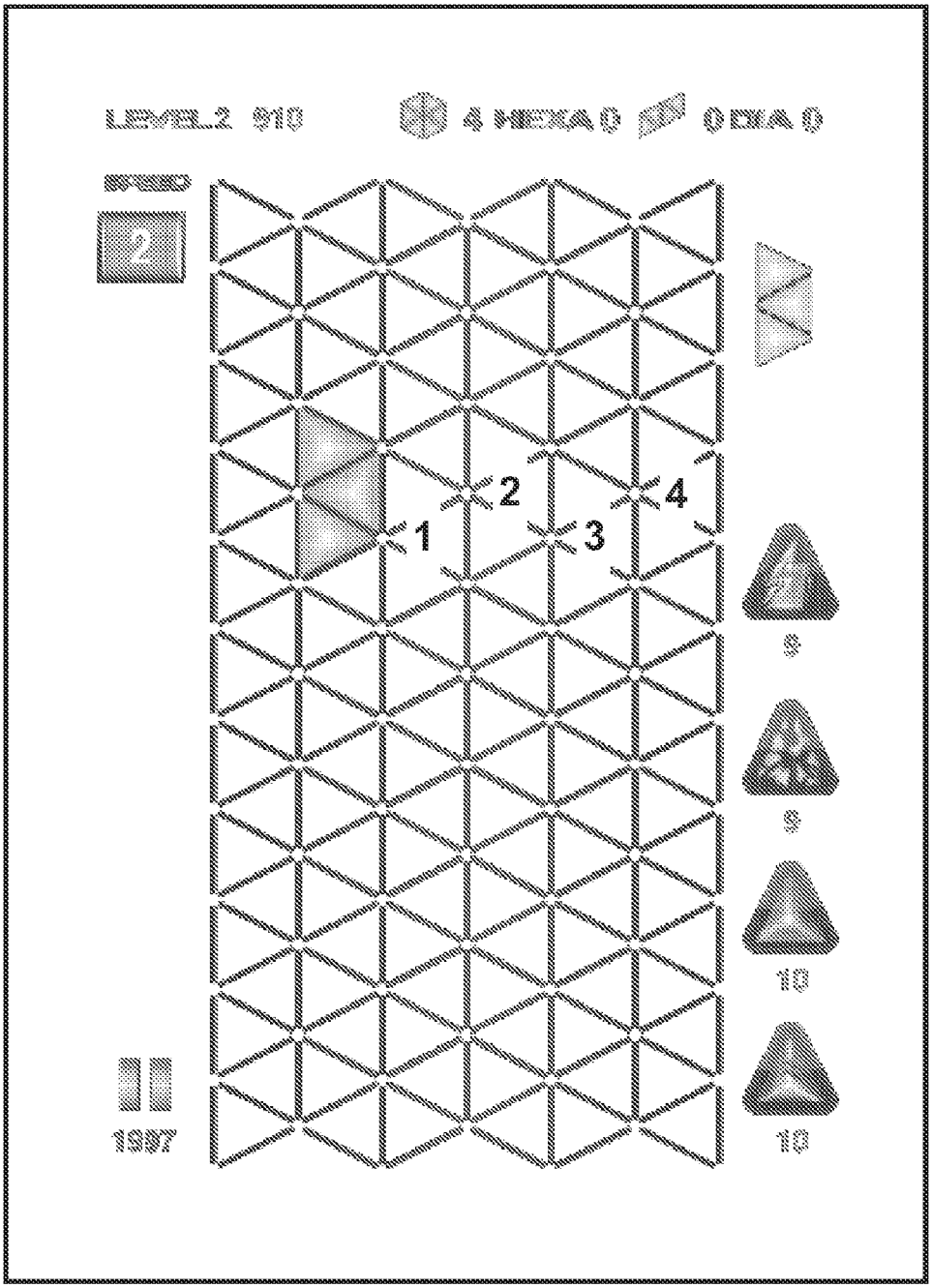
Figure 4H:
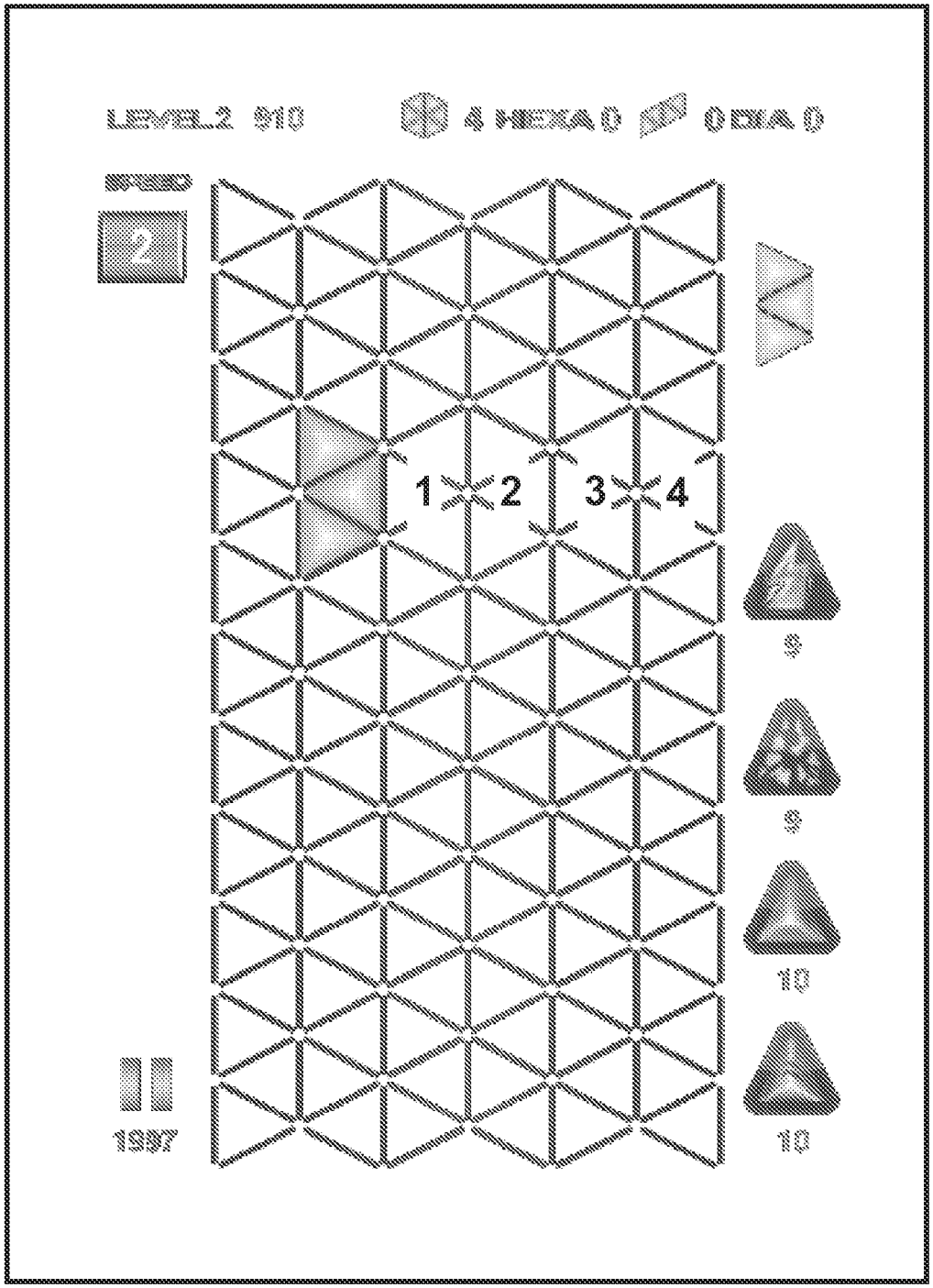
Figure 4I:
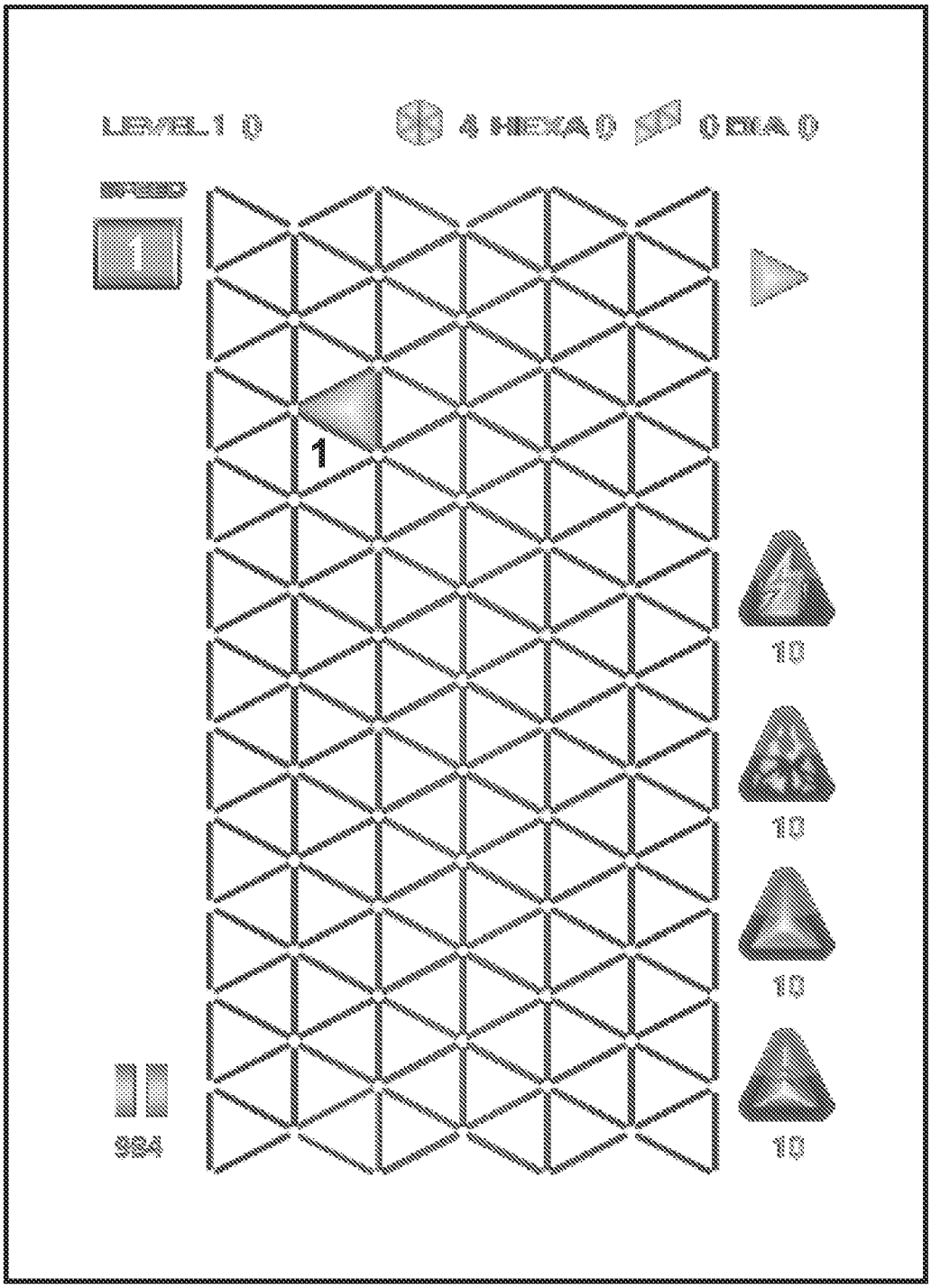
Figure 4J:
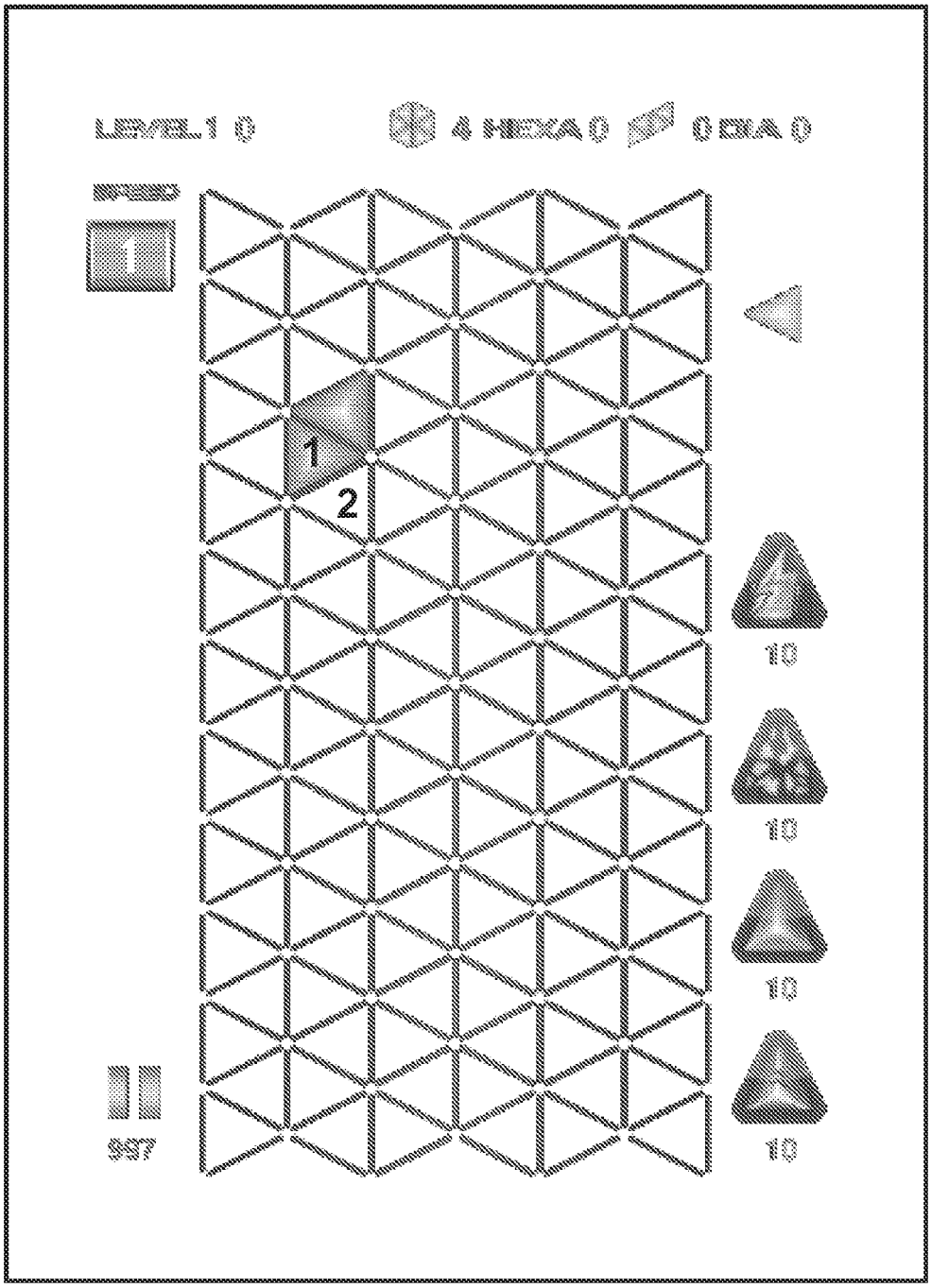
Figure 4K:
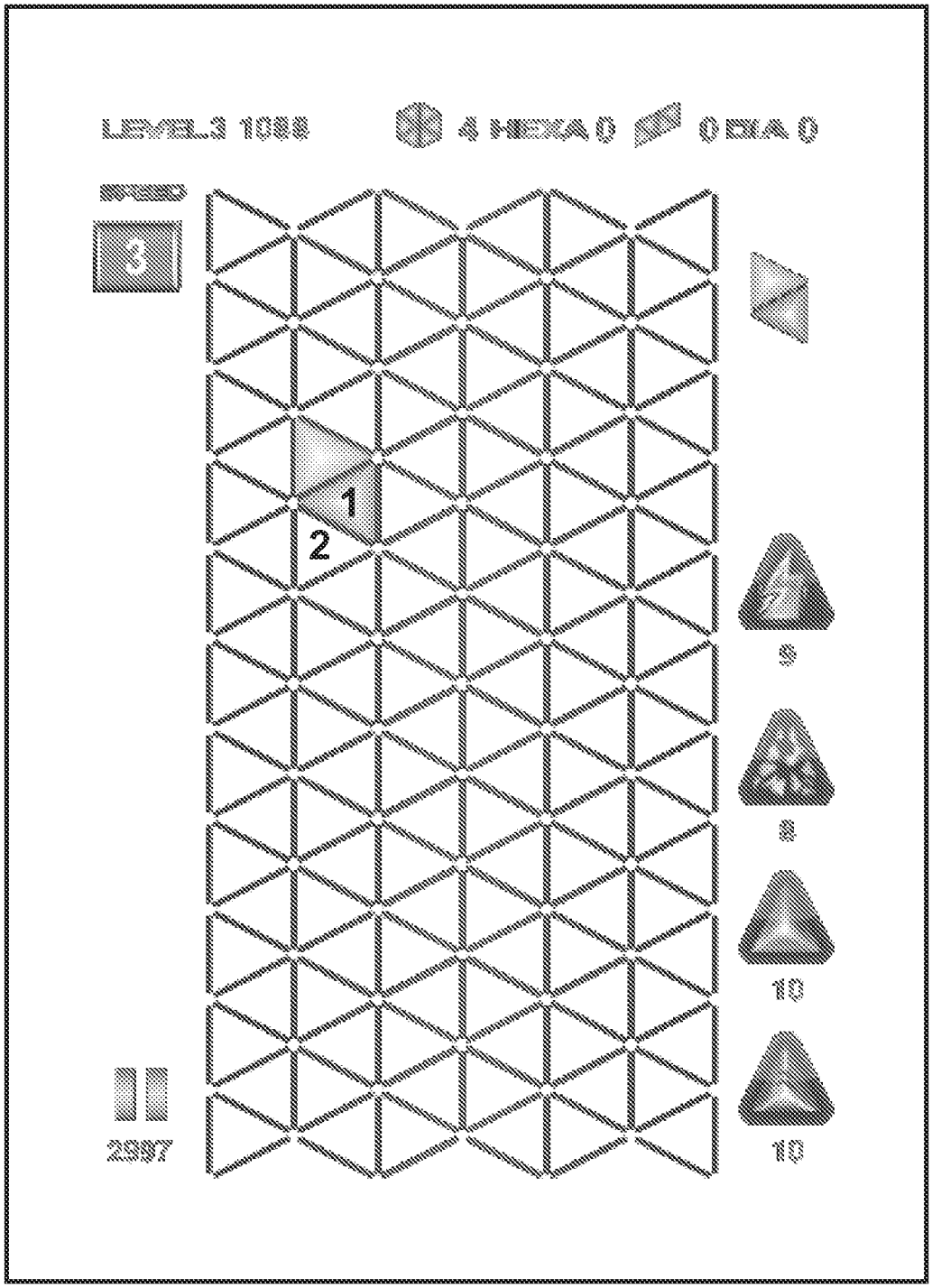
Figure 4I:
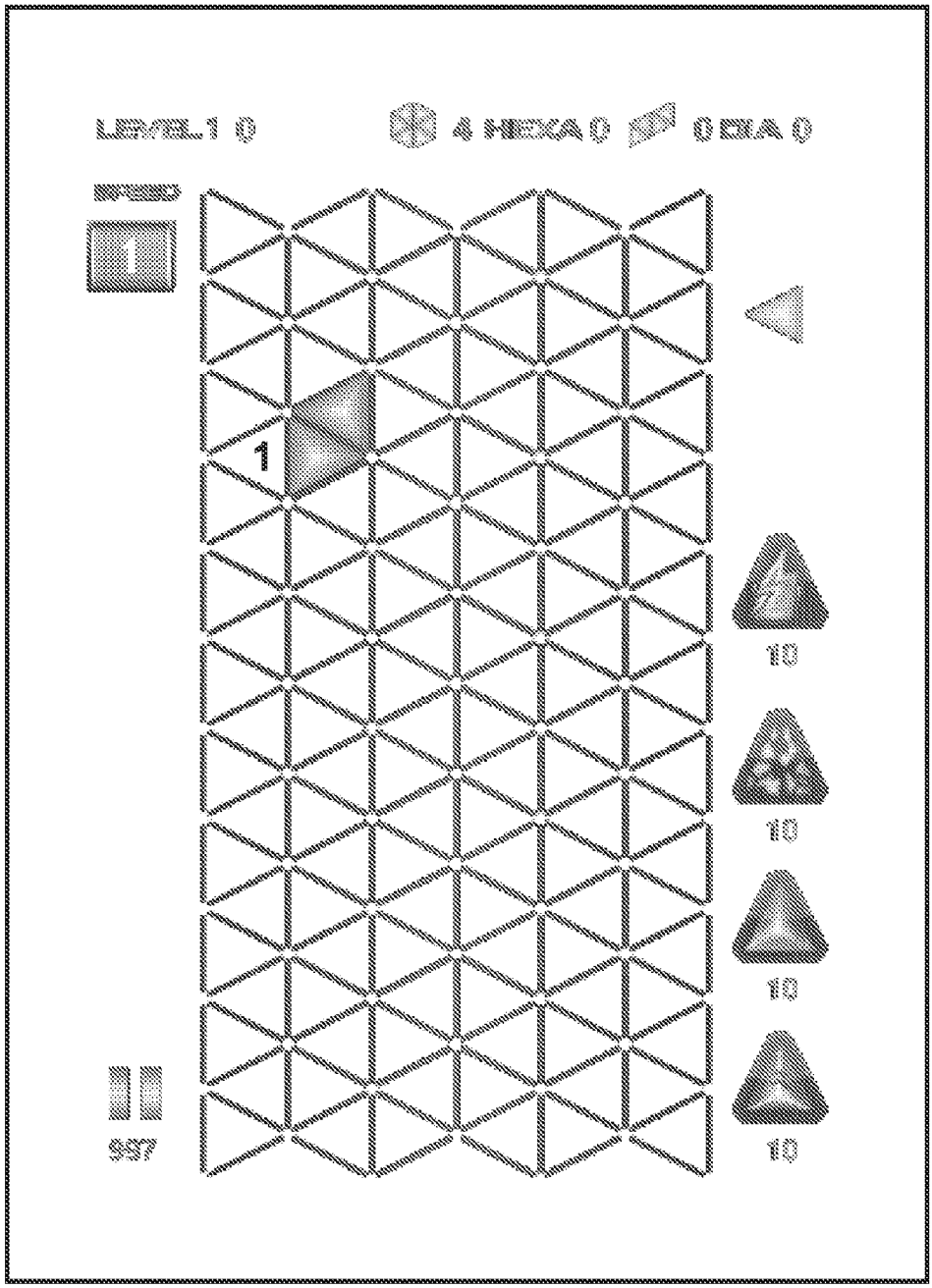
Figure 4M:
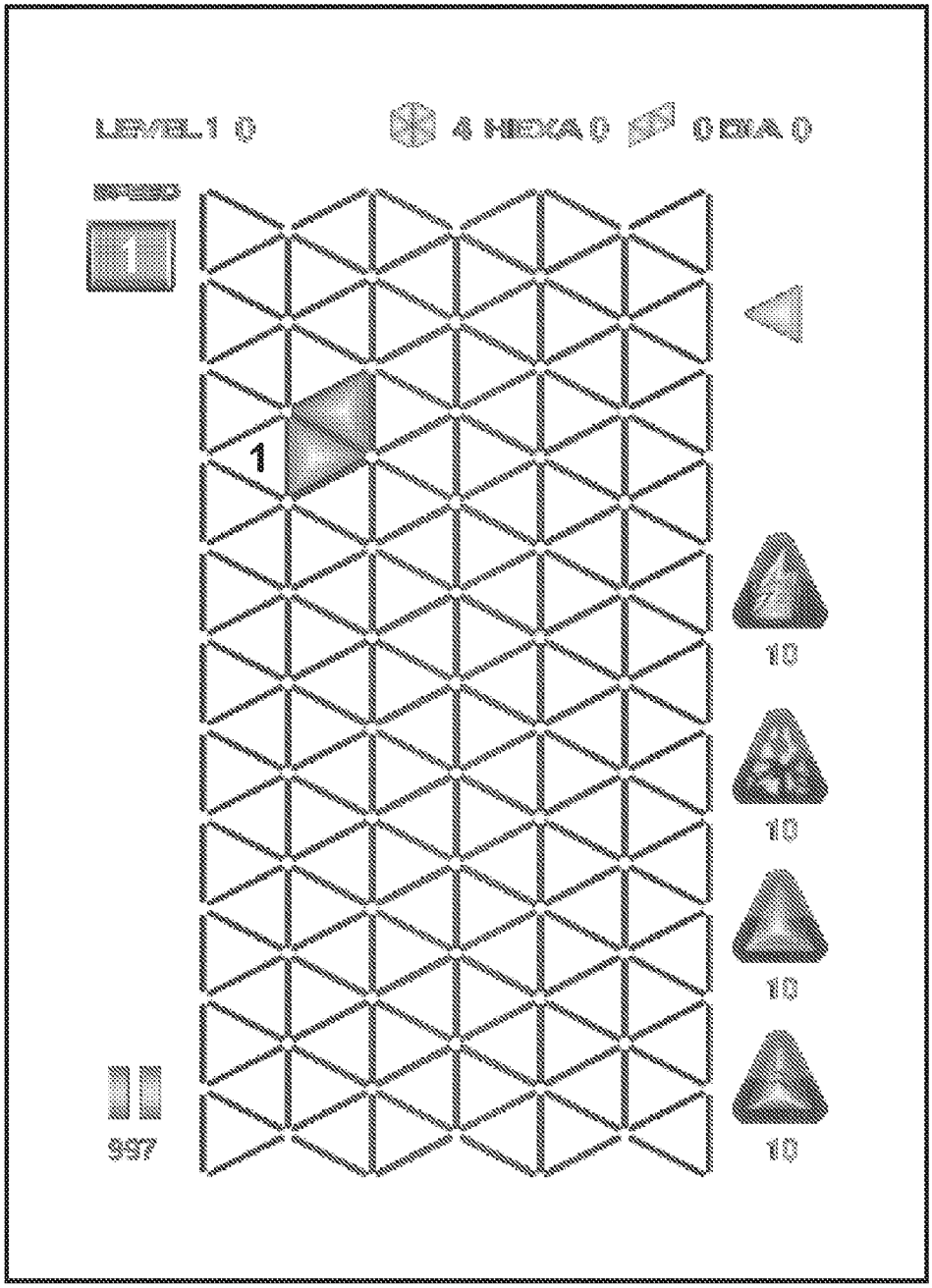
Figure 4N:
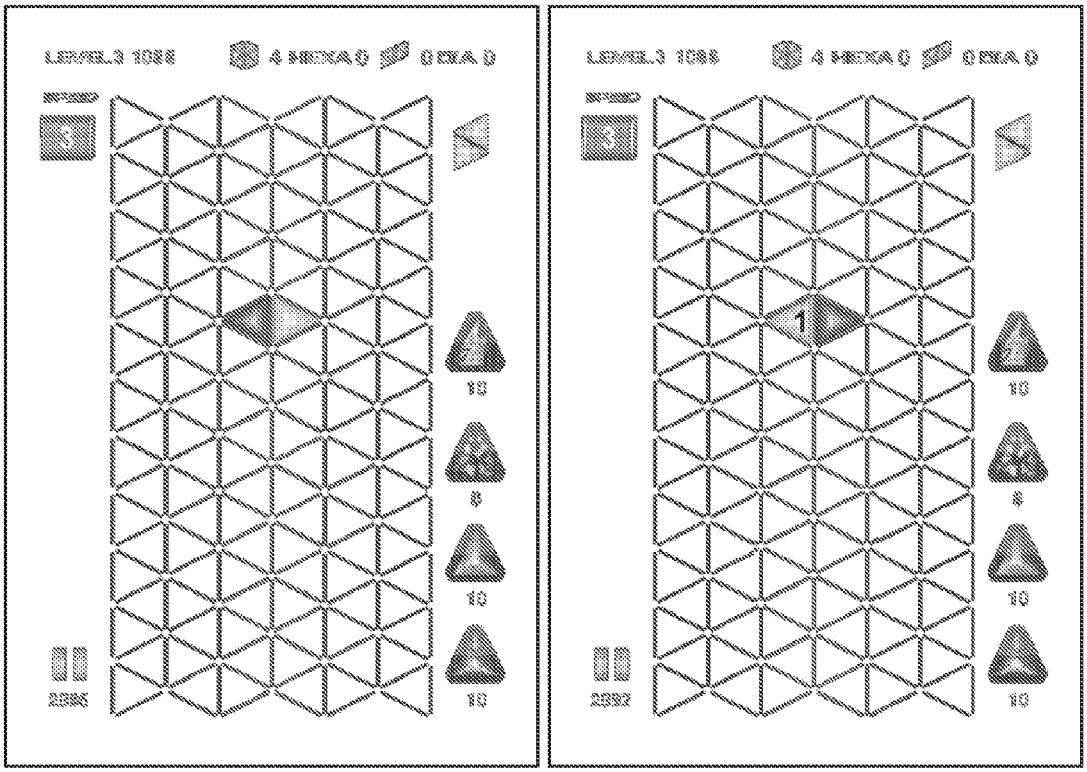
Figure 4O:
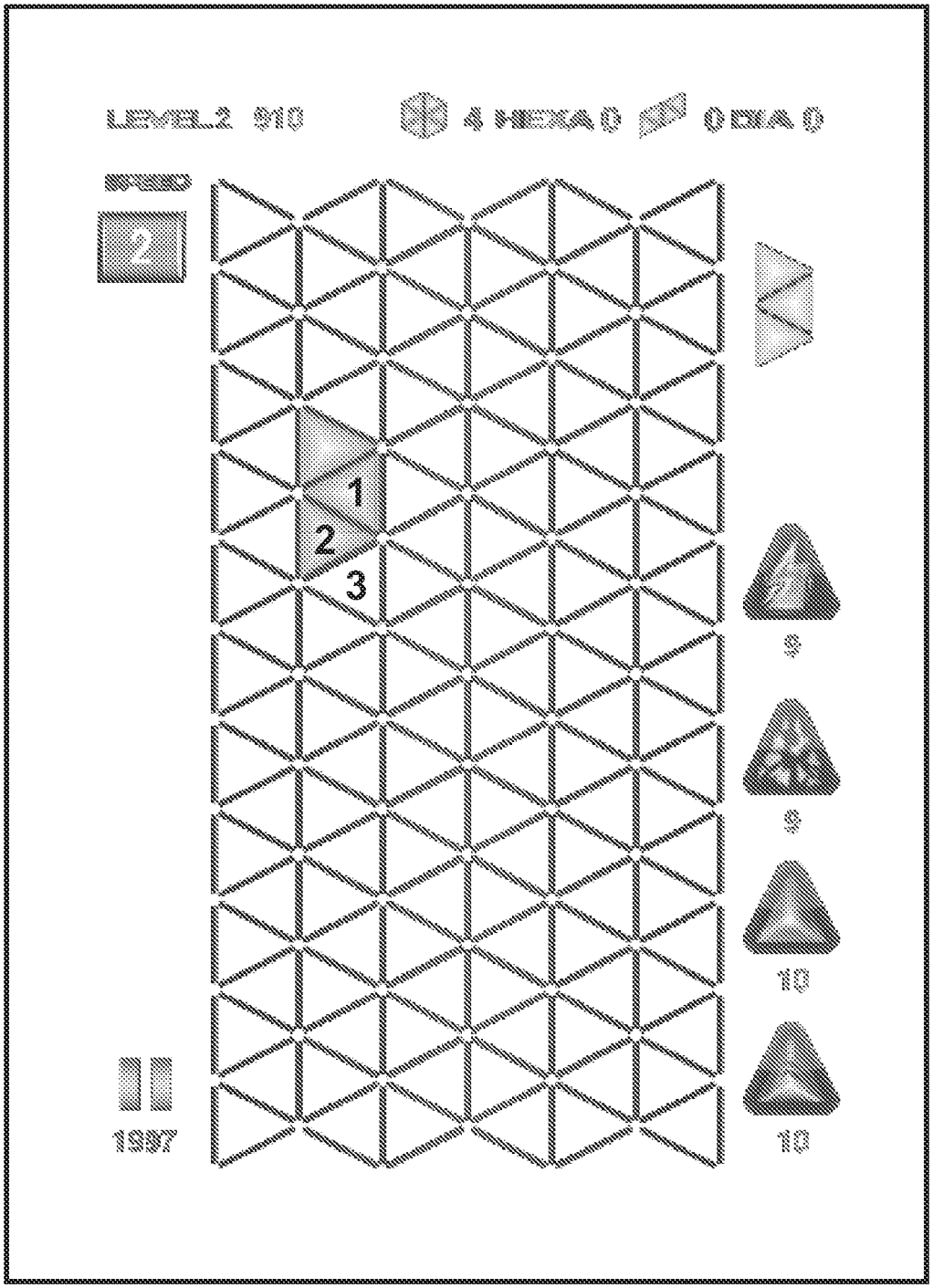

FIGS. 4*a*-4*o* illustrate some methods of movement falling game pieces can take in a Triangular Grid according to the embodiment of the present invention.

FIG. 4*a* shows one method of moving a Single Primary piece right horizontally within the bounds of the Triangular Grid. The first horizontal shift moves the piece to Position 1, which is a cell right and then, a cell below the original position. The second horizontal shift moves the piece to Position 2, which is a cell right and then, a cell row above Position 1. The third horizontal shift moves the piece to Position 3, which is a cell right and then, a cell row below Position 2. The fourth horizontal shift moves the piece to Position 4, which is a cell right and then, a cell row above Position 3. The movement continues in the same pattern and is also true for Secondary Pieces in the same shape and color arrangement. This movement method allows the pieces to maintain the same orientation as it moves horizontally across the Triangular Grid.

FIG. 4*b* shows another method of moving a Single Primary piece right horizontally within the bounds of the Triangular Grid. The first horizontal shift moves the piece to Position 1, which is a cell directly to the immediate right of the original position. To achieve this, the piece has had to flip horizontally. The second horizontal shift moves the piece to Position 2, which is a cell directly to the immediate right of Position 1. To achieve this, the piece in Position 1 has had to flip horizontally. The third horizontal shift moves the piece to Position 3, which is a cell directly to the immediate right of Position 2. To achieve this, the piece in Position 2 has had to flip horizontally. The fourth horizontal shift moves the piece to Position 4, which is a cell directly to the immediate right of Position 3. To achieve this, the piece in Position 3 has had to flip horizontally. The movement continues in the same pattern and is also true for Secondary Pieces in the same shape and color arrangement. This movement method allows the piece to remain in the same cell row, without moving up or down cells. But to do this, the piece has to change its orientation as it moves horizontally across the Triangular Grid.

FIG. 4*c* shows one method of moving a Double Primary piece, made of two similar colored triangles, right horizontally within the bounds of the Triangular Grid. The first horizontal shift moves the top triangle of the piece to Position 1, which is a cell right and then, a cell below the original position. The bottom piece follows, maintaining the shape and orientation. The second horizontal shift moves the top triangle piece to Position 2, which is a cell right and then, a cell row above Position 1. The bottom piece follows maintaining the shape and orientation. The third horizontal shift moves the piece to Position 3, following the same method of the first horizontal shift. The movement continues in the same pattern and is also true for Secondary Pieces in the same shape and color arrangement. This movement method allows the pieces to maintain the same orientation as it moves horizontally across the Triangular Grid.

FIG. 4*d* shows another method of moving a Double Primary piece, made of two similar colored triangles, right horizontally within the bounds of the Triangular Grid. The first horizontal shift moves the top triangle of the piece to Position 1, which is a cell directly to the immediate right of the original position. To achieve this, the piece has had to flip horizontally. The bottom piece follows maintaining the shape. The second horizontal shift moves the top triangle of the piece to Position 2, which is a cell directly to the immediate right of Position 1. To achieve this, the piece in Position 1 has had to flip horizontally. The bottom piece follows maintaining the shape. The third horizontal shift moves the piece to Position 3, following the same method of the first horizontal shift. The movement continues in the same pattern and is also true for Secondary Pieces in the same shape and color arrangement. This movement method allows the piece to remain in the same cell rows, without moving up or down cells. But to do this, the piece has to change its orientation as it moves horizontally across the Triangular Grid.

FIG. 4*e* shows one method of moving a Double Primary piece, made of two different colored triangles, right horizontally within the bounds of the Triangular Grid. The horizontal shifts in Positions 1 to 4 follow the same method of movement as similar-colored Double Primary pieces explained under FIG. 4*c*. This movement method allows different colored Double Primary pieces to maintain the same orientation as it moves horizontally across the Triangular Grid.

FIG. 4*f* shows another method of moving a Double Primary piece, made of two different colored triangles, right horizontally within the bounds of the Triangular Grid. The horizontal shifts in Positions 1 to 4 follow the same method of movement as similar-colored Double Primary pieces explained under FIG. 4*d*. This movement method allows different colored Double Primary pieces to remain in the same cell rows, without moving up or down cells. But to do this, the piece has to change its orientation as it moves horizontally across the Triangular Grid.

FIG. 4*g* shows one method of moving a Triple Primary piece, made of three similar colored triangles, right horizontally within the bounds of the Triangular Grid. The first horizontal shift moves the top triangle of the piece to Position 1, which is a cell right and then, a cell below the original position. The bottom pieces follow, maintaining the shape and orientation. The second horizontal shift moves the top triangle piece to Position 2, which is a cell right and then, a cell row above Position 1. The bottom pieces follow maintaining the shape and orientation. The third horizontal shift moves the piece to Position 3, following the same method of the first horizontal shift. The movement continues in the same pattern and is also true for Secondary Pieces in the same shape and color arrangement. This movement method allows the pieces to maintain the same orientation as it moves horizontally across the Triangular Grid.

FIG. 4*h* shows another method of moving a Triple Primary piece, made of three similar colored triangles, right horizontally within the bounds of the Triangular Grid. The first horizontal shift moves the top triangle of the piece to Position 1, which is a cell directly to the immediate right of the original position. To achieve this, the piece has had to flip horizontally. The bottom pieces follow maintaining the shape The second horizontal shift moves the top triangle of the piece to Position 2, which is a cell directly to the immediate right of Position 1. To achieve this, the piece in Position 1 has had to flip horizontally. The bottom pieces follow maintaining the shape. The third horizontal shift moves the piece to Position 3, following the same method of the first horizontal shift. The movement continues in the same pattern and is also true for Secondary Pieces in the same shape and color arrangement. This movement method allows the piece to remain in the same cell rows, without moving up or down cells. But to do this, the piece has to change its orientation as it moves horizontally across the Triangular Grid.

FIG. 4*i* shows one method of rotating a Single Primary piece within the bounds of the Triangular Grid. When the piece is tapped once or influenced to rotate once, it moves to Position 1, having rotated 180 degrees within the same column. To achieve this orientation, the piece has to move down one cell in the Triangular Grid.

FIG. 4*j* shows one method of rotating a Double Primary piece, made of two similar colored triangles within the bounds of the Triangular Grid. When the piece is tapped once or influenced once to rotate, the top triangle of the piece moves to Position 1, having rotated 180 degrees within the same column. The bottom triangle moves to Position 2. To achieve this orientation, the piece has to move down one cell in the Triangular Grid.

FIG. 4*k* shows one method of rotating a Double Primary piece made of two different colored triangles within the bounds of the Triangular Grid. When the piece is tapped once or influenced once to rotate, the top Green triangle of the piece moves to Position 1, currently held by the blue piece, having rotated 180 degrees within the same column. The bottom blue piece moves to Position 2. To achieve this orientation, the piece has to move down one cell in the Triangular Grid.

FIG. 4*l* shows one method of custom moving a Double Primary piece made of similar colored triangles to a horizontal orientation within the bounds of the Triangular Grid. Certain game pieces can be influenced in a special way to perform a custom movement. By way of an example, in the case of a mobile device with a touch screen, when a finger or pointing device is held down against the touch screen for a short duration to cause a special movement, the top triangle of the piece moves to Position 1 in another column. The bottom triangle remains as it is. To achieve this orientation, the piece has to move down one cell in the Triangular Grid.

FIG. 4*m* shows one method of custom moving a Double Primary piece made of two different colored triangles to a horizontal orientation within the bounds of the Triangular Grid. Certain game pieces can be influenced in a special way to perform a custom movement. By way of an example, in the case of a mobile device with a touch screen, when a finger or pointing device is held down against the touch screen for a short duration to cause a special movement, the top triangle of the piece moves to Position 1 in another (next) column. The bottom triangle remains as it is. To achieve this orientation, the piece has to move down one cell in the Triangular Grid.

FIG. 4*n* shows a method of interchanging the color between two triangles of a Double Primary piece made of two different colored triangles, once the piece is in a new horizontal orientation after a custom movement, which was discussed and illustrated using FIG. 4*m*. When the piece is tapped once or influenced once, the right triangle (blue in diagram) takes the color of the left triangle (green in diagram) while the left triangle takes the color of the right. The piece can remain in the same cells in the Triangular Grid.

FIG. 4*o* shows one method of rotating a Triple Primary piece made of three same colored triangles within the bounds of the Triangular Grid. When the piece is tapped once or influenced once to rotate, the top triangle of the piece moves to Position 1, having rotated 180 degrees within the same column. The middle triangle will move down a cell to Position 2 while the bottom triangle will move down a cell to Position 3. To achieve this orientation, the piece has to move down one cell in the Triangular Grid.

Figure 5:
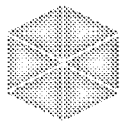
FIG. 5 is a chart illustrating the scoring of the game in its regular mode defined by levels requiring a certain number of formations to be created by the player during a given time period (referred to as the "JUPITER" game mode) and the Infinity game mode scoring where various formations created by a player during game play are rewarded with a fixed score per formation.
Figure 5:
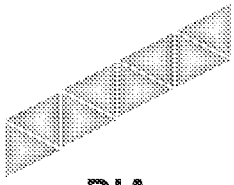
Figure 5:
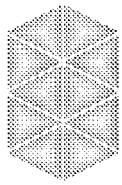
Figure 5:
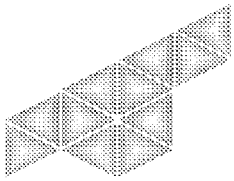

FIG. 5 is a chart illustrating game formations along with their points or calculation formula for different game modes in one embodiment of the present invention. In this example, the regular game mode (referred to as "JUPITER") is to consist of levels in which the player has to create certain formations during a given time period in order to move to the next level.

In regular game play mode, the desired formations that must be created by a player for scoring are the hexagonal shape (also referred to as a HEXA) comprised of six individual triangles of the same color; a diagonal string of a plurality of triangles of the same color which in a preferred game embodiment is a diagonal string of eight triangles; a Di-Hexa shape which is comprised of 10 triangles of the same color, where the middle two triangles are shared by the outer four triangles to each side to create two hexagonal shapes; and a Hex-Tri shape which is comprised of a diagonal string of a plurality of triangles of the same color which in a preferred game embodiment is a diagonal string of eight triangles which also shares three triangles with three triangles immediately above or below the diagonal string to create a hexagonal shape.

Scoring in the regular mode, in one embodiment of the game is as follows and is illustrated in FIG. 5. For the HEXA shape, it is the time remaining for the player to clear the level divided by four. For the DIA shape it is the time remaining for the player to clear the level. For the DI-HEXA shape, it is two times the score for a HEXA shape. For the HEX-TRIA shape, it is three times the HEXA shape score plus the DIA shape score.

The present invention also includes an Infinite game mode executable on a PDA or mobile device that allows players to play until the battery in their device runs out or the device shuts off due to a low battery. Infinite game mode has no defined levels and set scores are awarded to various possible formations that can be made. To provide added degree of difficulty in this mode, the Triangular Grid can begin to lose some of its triangular cells for empty cells, providing a smaller grid area to create formations. In the Infinity game mode, scoring is based on the various formations created by a player during game play and is rewarded with a fixed score per formation as show in FIG. 5.

Figure 6:
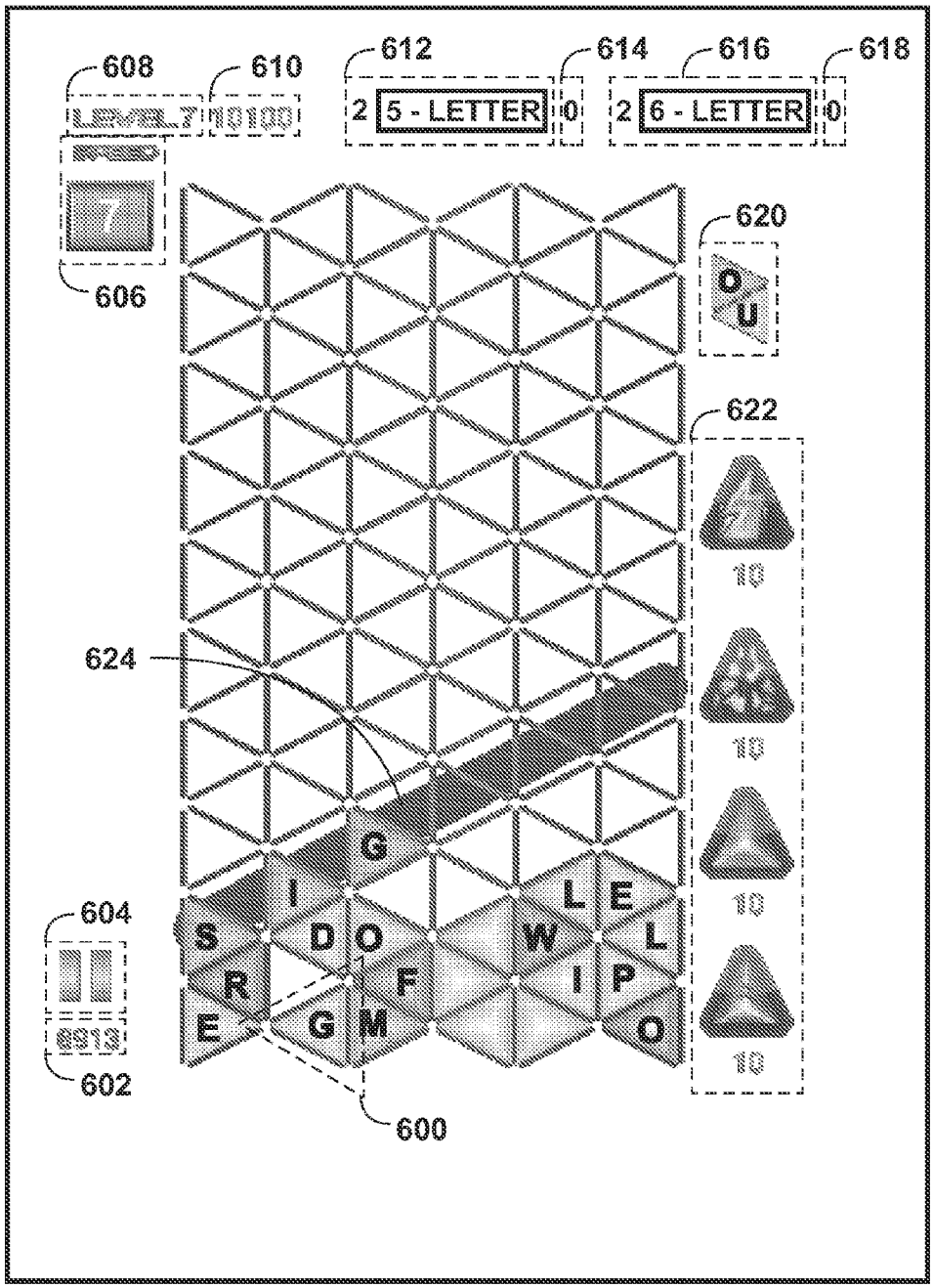
FIG. 6 is a representative view showing one example of a game screen as displayed on a PDA or mobile device applied to another embodiment of the present invention.

While FIGS. 1*a* and 1*b* provided a screenshot representation of one embodiment of the present invention, FIG. 6 illustrates another embodiment of the present invention, where the set of Primaries is made of triangle pieces, each made of one or a plurality of colors, and each triangle piece of a Single Primary piece, Double Primary piece or a Triple Primary piece includes one or more Grapheme 600. The challenge for the player is to move, rotate or influence the Primaries to create the target 5-Letter and 6-Letter Word formations for a level.

Again referring to FIG. 6, the diagonal line 624 is used to demonstrate the possibility of creating a 5-Letter Word (example "STING") or a 6-Letter word (example "STINGY") in the English language using a DIA (Diagonal) formation.

For this embodiment, formations include but are not limited to the construction of Words, Names, Phrases, Clauses and Sentences using Grapheme 600 in the arrangement of Geometric shapes, forms and objects.

For this embodiment, formations include but are not limited to the construction of Words, Names, Phrases, Clauses and Sentences using Grapheme 600 in the English language only.

The same exemplary set of Secondaries, the Bonus, Destroyer and Block still hold for this embodiment, with the Bonus Secondary Piece substituting any single Primary triangle so that it can represent any color or any Grapheme 600.

The same exemplary set of Reward buttons, Explode, Bonus and Destroyer holds for this embodiment, apart from a slight variation of the Color Button to a Grapheme button. Similar in behavior to a Color Button, the Grapheme button allows a player to change one or more Grapheme 600 contained in a falling Primary piece by tapping or influencing the Grapheme button any number of times, in turn rotating the falling Primary piece through possible common or useful Grapheme sets before the piece lands. An example of a useful Grapheme set is the set of vowels when the Grapheme is alphabets from the English language.

FIG. 6 also shows a Level Indicator 608, the Score 610, the Target 5-Letter Word formations 612 for the level, the number of 5-Letter Word formations 614 the player has created so far in the level, the Target 6-Letter Word formations 616 for the level, the number of 6-Letter Word formations 618 the player has created so far in the level, an upcoming Grapheme piece Preview 620, the Speed Setting 606, a Pause button 604, and a Count Down Clock 602 that shows the time remaining to reach the level target and Reward Buttons 622.

In another embodiment of the present invention, the set of Primaries is made of triangle pieces, each made of one or a plurality of colors, and each individual triangle piece also includes one or more Grapheme. For this embodiment, formations include but are not limited to the construction of Words, Names, Phrases, Clauses and Sentences using Grapheme in the arrangement of Geometric shapes, forms and objects.

In still another embodiment, formations include tessellations and tiling. Tiling formations allow for jigsaw puzzles where the entire set of Primaries, or a small set from it include part of a subject, theme, object or picture, and these can be influenced and interlocked to assemble the final picture.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. A method for a computer game executable and rendered on the display of a portable device, the method comprising:
- providing on and executing by a computer;
- displaying a triangular playing grid comprising rows and columns of cells, each of the plurality of cells capable of holding an object, each object having a type;
- presenting an object for positioning in a grid;
- moving each object in the grid to a cell adjacent to and below the object unless that cell is occupied by another object or the object is in the bottom most row;
- identifying objects that result in a desired formation due to their position in the grid;
- deleting all objects when they create a desired formation;
- shifting any objects previously resting on the now deleted objects and their previously occupied cell down in the grid to a cell adjacent to and below the object unless that cell is occupied by another object or the object is in the bottommost row;
- providing an award for the creation of a desired formation;
- requiring the creation of certain formations during a given time period in order to move to the next level;
- wherein the desired formations that must be created by a player for scoring are as follows:
- the hexagonal shape comprised of six individual triangles of the same color;
- a diagonal string of a plurality of triangles of the same color which in a preferred game embodiment is a diagonal string of eight triangles;
- a Di-Hexa shape which is comprised of 10 triangles of the same color, where the middle two triangles are shared by the outer four triangles to each side to create two hexagonal shapes; and
- a Hex-Tri shape which is comprised of a diagonal string of a plurality of triangles of the same color which in a preferred game embodiment is a diagonal string of eight triangles which also shares three triangles with three triangles immediately above or below the diagonal string to create a hexagonal shape;
- scoring is as follows:
- for the HEXA shape, it is the time remaining for the player to clear the level divided by four;
- for the DIA shape it is the time remaining for the player to clear the level;
- for the DI-HEXA shape, it is two times the score for a HEXA shape; and
- for the HEX-TRIA shape, it is three times the HEXA shape score plus the DIA shape score.

2. The method of claim 1, wherein the primary falling pieces in the game include
- single triangle pieces of varying color;
- double triangle pieces where two triangles are oriented such that one side of each triangle is opposite and parallel to each other; and
- triple triangles that are arranged to form a trapezoidal shape wherein two triangles surround a middle triangle oriented opposite of the two end triangles.

3. The method of claim 2, further comprising the steps of
- providing a first movement option for moving a single primary or secondary piece in the same shape and color arrangement as the primary right horizontally within the bounds of the triangular grid comprising the steps of:
  - moving a piece to a first position which is a cell right and then a cell below the original position;
  - moving a piece to a second position which is a cell right and then a cell row above the first position;
  - moving a piece to a third position which is a cell right and then a cell row below the second position;
  - moving a piece to a fourth position is a cell right and then a cell row above the third position;
  - repeating the movement in the same pattern;
  - allowing the pieces to maintain the same orientation as it moves horizontally across the triangular grid;
- providing a second movement option moving a single primary piece right horizontally within the bounds of the triangular grid comprising the steps of:
  - moving the piece to a first position, which is a cell directly to the immediate right of the original position by flipping the piece horizontally;
  - moving the piece to a second position which is a cell directly to the immediate right of the first position by flipping the piece placed into the first position horizontally;
  - moving the piece to a third position which is a cell directly to the immediate right of the second position by flipping the piece placed into the second position horizontally;
  - moving the piece to a fourth position which is a cell directly to the immediate right of the third position by flipping the piece placed into the third position horizontally;
  - repeating the movement in the same pattern; and
  - allowing the pieces to maintain the same orientation as it moves horizontally across the triangular grid.

4. The method of claim 2, further comprising the steps of
- providing a movement option for moving a double primary piece or secondary pieces in the same shape and color arrangement, made of two similar colored triangles, right horizontally within the bounds of the triangular grid comprising the steps of:
  - a first horizontal shift moving the top triangle of the piece to a first position, which is a cell right and then a cell below the original position, the bottom piece follows, maintaining the shape and orientation;

a second horizontal shift moving the top triangle piece to a second position, which is a cell right and then a cell row above the first position, the bottom piece follows maintaining the shape and orientation;

a third horizontal shift moving the top triangle of the piece to a first position, which is a cell right and then a cell below the original position, the bottom piece follows, maintaining the shape and orientation which allows the pieces to maintain the same orientation as it moves horizontally across the triangular grid;

repeating the movement in the same pattern;

allowing the pieces to maintain the same orientation as it moves horizontally across the triangular grid;

providing a movement option for a double primary piece made of two similar colored triangles, right horizontally within the bounds of the triangular grid comprising the steps of:

a first horizontal shift moving the top triangle of the piece to a first position, which is a cell directly to the immediate right of the original position by flipping the piece horizontally, and the bottom piece follows maintaining the shape;

a second horizontal shift moving the top triangle of the piece to a second position, which is a cell directly to the immediate right of the first position by flipping the piece in the first position horizontally, and the bottom piece follows maintaining the shape; and a third horizontal shift moving the piece to a third position, following the same method of the first horizontal shift that allows the piece to remain in the same cell rows, without moving up or down cells;

repeating the movement in the same pattern; and allowing the pieces to maintain the same orientation as it moves horizontally across the triangular grid.

5. The method of claim 2, further comprising the steps of providing a movement option for a double primary piece, made of two different colored triangles, right horizontally within the bounds of the triangular grid comprising the steps of:

a first horizontal shift moving the top triangle of the piece to a first position, which is a cell right and then a cell below the original position, the bottom piece follows, maintaining the shape and orientation;

a second horizontal shift moving the top triangle piece to a second position, which is a cell right and then a cell row above the first position, the bottom piece follows maintaining the shape and orientation;

a third horizontal shift moving the top triangle of the piece to a first position, which is a cell right and then a cell below the original position, the bottom piece follows, maintaining the shape and orientation which allows the pieces to maintain the same orientation as it moves horizontally across the triangular grid;

repeating the movement in the same pattern;

allowing the pieces to maintain the same orientation as it moves horizontally across the triangular grid;

providing a movement option for a Double Primary piece, made of two different colored triangles, right horizontally within the bounds of the Triangular Grid comprising the steps of a first horizontal shift moving the top triangle of the piece to a first position, which is a cell directly to the immediate right of the original position by flipping the piece horizontally, and the bottom piece follows maintaining the shape;

a second horizontal shift moving the top triangle of the piece to a second position, which is a cell directly to the immediate right of the first position by flipping the piece in the first position horizontally, and the bottom piece follows maintaining the shape; and a third horizontal shift moving the piece to a third position, following the same method of the first horizontal shift that allows the piece to remain in the same cell rows, without moving up or down cells;

repeating the movement in the same pattern; and allowing the pieces to maintain the same orientation as it moves horizontally across the triangular grid.

6. The method of claim 2, further comprising the steps of providing a movement option for a triple primary piece, made of three similar colored triangles, right horizontally within the bounds of the triangular grid;

a first horizontal shift moving the top triangle of the piece to a first position which is a cell right and then a cell below the original position, the bottom pieces follow, maintaining the shape and orientation;

a second horizontal shift moving the top triangle piece to a second position, which is a cell right and then, a cell row above the first position, the bottom pieces follow maintaining the shape and orientation;

a third horizontal shift moving the piece to a third position, moving the top triangle of the piece to a first position which is a cell right and then a cell below the original position, the bottom pieces follow, maintaining the shape and orientation;

repeating the movement in the same pattern;

allowing the pieces to maintain the same orientation as it moves horizontally across the triangular grid;

providing a movement option for a Triple Primary piece, made of three similar colored triangles, right horizontally within the bounds of the Triangular Grid;

a first horizontal shift moving the top triangle of the piece to a first position, which is a cell directly to the immediate right of the original position by flipping the piece horizontally, the bottom pieces follow maintaining the shape;

a second horizontal shift moving the top triangle of the piece to a second position, which is a cell directly to the immediate right of the first position by flipping the piece in the first position horizontally; the bottom pieces follow maintaining the shape;

a third horizontal shift moving the piece to a third position, moving the top triangle of the piece to the third position, which is a cell directly to the immediate right of the second position by flipping the piece horizontally, the bottom pieces follow maintaining the shape;

repeating the movement in the same pattern; and allowing the pieces to maintain the same orientation as it moves horizontally across the triangular grid.

7. The method of claim 1, further comprising the steps of creating a target number of formations of geometric shapes, forms, and objects per level using a set of primary sub-formations.

8. The method of claim 7, further comprising the steps of providing secondary sub-formations made up of one or more triangle pieces joined together; and assigning each secondary sub-formation a different attribute to each other or to Primary pieces.

9. The method of claim 7, further comprising the steps of providing a set of reward buttons, which are awarded for completing different formations; and influencing the state of a current falling piece or influencing the state of the next falling piece that is queued by the reward button.

10. The method of claim 1, further comprising the steps of scoring where points are calculated based on the formations created by a player and the time remaining in the level.

11. The method of claim 1, wherein the triangular grid of triangular cells is defined by grid lines, which are rendered and aid understanding of the invention and ease playability;

the triangular grid is set into a frame that bounds the playing area of the game;

the triangular grid can be bound within a rectangular area, or any regular or any irregular shaped area can bind it;

the triangular grid can be completely filled with triangular cells, or it can be a combination of areas with triangular cells and areas where the regular triangular cells are missing; and areas with missing triangular cells provide added degree of difficulty in the game.

12. The method of claim 1, wherein the triangular cells are capable of holding one triangle piece of a primary or a secondary piece at a time;

triangle pieces held by cells can be of any color, however, the triangle pieces must be in the same orientation in order to fit into a cell although they may even be differentiated by color;

the triangle pieces are movable by a player through an input means of the portable device or computer;

the triangle pieces can be moved left, right, and down within the bounds of the grid; and the triangular pieces can be influenced to rotate them or be held to place it into a horizontal position.

13. The method of claim 1, further comprising the steps of providing a level indicator;

displaying one or more form the following group:

the score;

the HEXA shape goal for the level and corresponding number of HEXA formations created so far during play in the level;

the DIA shape goal for the level and corresponding number of DIA formations created so far during play in the level;

an upcoming Primary piece preview;

the speed setting;

a pause button; and a count down clock illustrating the time remaining to reach the level goal.

14. The method of claim 11, wherein single triangles can be in any color;

double triangles can either be comprised of two similar colored triangles or two triangles of any two colors; and triple triangles can be comprised of three similar colored triangles or three triangles with any color from three different colors.

15. The method of claim 1, further comprising the steps of maneuvering primary game pieces into a desired position before they reach either the bottom of the grid or another game piece that does not allow the falling game piece to continue its downward, falling motion and it becomes fixed on the grid; and maneuvering a primary game pieces to the left, right, or increase its rate of fall in the downward direction.

16. The method of claim 1, wherein the grid is triangular;

a single triangle piece can be tapped or influenced to rotate it 180 degrees;

a double triangle, whether of two similar colored triangles or two different colored ones, can be tapped or influenced to rotate it 180 degrees or held down to rotate it to a horizontal orientation on the grid; and a triple triangle can be tapped to rotate it 180 degrees.

17. The method of claim 16, further comprising substitution of any single Primary triangle by a bonus secondary piece so that it can represent any color;

providing a destroyer secondary piece that destroys everything as it falls in its path;

providing a block secondary piece which blocks the grid cells where it lands, disallowing the creation of any formation on those cells; and providing a Color Button that allows changing the color of a falling primary piece any number of times, in turn rotating the falling primary piece through all the possible colors, before the piece lands;

providing an Explode Button that allows a falling piece before it land; and providing a bonus button changes the next, previewed and queued, falling primary piece to a bonus secondary piece; and providing a destroyer button that changes the next, previewed and queued, falling primary piece to a destroyer secondary piece.

18. The method of claim 1, further comprising the steps of deleting created formations or objects matching the desired game formations upon a game piece reaching a fixed point in the grid;

allowing, upon such deletion any remaining objects in the grid, the remaining pieces to fall down the grid without the player having the ability or opportunity to manipulate them until they reach a new fixed point in the grid; and repeating the steps again if a created formation matching the desired game formations is reached; and rewarding points upon the successful creation, detection, and deletion of a desired game formation.

19. The method of claim 1, wherein the set of primaries is made of triangle pieces, each made of one or a plurality of colors, and each triangle piece of a single primary piece, double primary piece or a triple primary piece includes one or more Grapheme; and formations include the construction of Words, Names, Phrases, Clauses and Sentences using Grapheme in the arrangement of Geometric shapes, forms and objects.

* * * * *